US007587150B2

(12) United States Patent
Taguchi

(10) Patent No.: US 7,587,150 B2
(45) Date of Patent: Sep. 8, 2009

(54) IMAGE FORMING APPARATUS INCLUDING PLURAL DEVELOPERS AND IMAGE FORMING METHOD

(75) Inventor: Keiichi Taguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 426 days.

(21) Appl. No.: 11/377,616

(22) Filed: Mar. 15, 2006

(65) Prior Publication Data

US 2006/0216050 A1 Sep. 28, 2006

(30) Foreign Application Priority Data

Mar. 16, 2005 (JP) ..... 2005-074690
Mar. 16, 2005 (JP) ..... 2005-074693
Mar. 24, 2005 (JP) ..... 2005-085646
Mar. 24, 2005 (JP) ..... 2005-085655

(51) Int. Cl.
*G03G 15/08* (2006.01)
*G03G 15/01* (2006.01)

(52) U.S. Cl. ..... 399/53; 399/227

(58) Field of Classification Search ..... 399/53, 399/54, 227

See application file for complete search history.

(56) References Cited

U.S. PATENT DOCUMENTS 4,579,443 A * 4/1986 Abuyama et al. ..... 399/28
4,792,825 A * 12/1988 Saito et al. ..... 399/227
4,931,837 A * 6/1990 Abuyama et al. ..... 399/13
4,941,018 A * 7/1990 Kasamura et al. ..... 399/226
7,065,304 B2 * 6/2006 Taguchi ..... 399/12
2005/0201764 A1 * 9/2005 Okamoto et al. ..... 399/12

FOREIGN PATENT DOCUMENTS

JP 2003-316106 11/2003

* cited by examiner

*Primary Examiner*—David M Gray
*Assistant Examiner*—Joseph S Wong
(74) *Attorney, Agent, or Firm*—Hogan & Hartson LLP

(57) ABSTRACT

An image forming apparatus which includes: a plurality of developers each of which stores therein a toner of the same color and includes a toner carrier structured to rotate while carrying the toner on its surface; and a controller which executes an image forming operation using the developer in accordance with an image forming command, wherein the controller selects a developer from the plurality of developers based on a length of shutdown time from the end of use in the previous image forming operation and executes the image forming operation using the selected developer.

11 Claims, 26 Drawing Sheets

FIG. 8

FIRST TABLE

| CASE NO. | CURRENT STATUS OF DEVELOPER | | | | LAST DEVELOPER | | | |
|---|---|---|---|---|---|---|---|---|
| | 4Ka | 4Kb | 4Kc | 4Kd | 4Ka | 4Kb | 4Kc | 4Kd |
| 1 | ○ | ○ | ○ | ○ | 4Kb | 4Kc | 4Kd | 4Ka |
| 2 | ○ | ○ | ○ | — | 4Kb | 4Kc | 4Ka | 4Ka |
| 3 | ○ | ○ | — | ○ | 4Kb | 4Kd | 4Kd | 4Ka |
| 4 | ○ | ○ | — | — | 4Kc | 4Kc | 4Ka | 4Ka |
| 5 | ○ | — | ○ | ○ | 4Kc | 4Kc | 4Kd | 4Ka |
| 6 | ○ | — | ○ | — | 4Kc | 4Kc | 4Ka | 4Ka |
| 7 | ○ | — | — | ○ | 4Kd | 4Kd | 4Kd | 4Ka |
| 8 | ○ | — | — | — | 4Ka | 4Ka | 4Ka | 4Ka |
| 9 | — | ○ | ○ | ○ | 4Kb | 4Kc | 4Kd | 4Kb |
| 10 | — | ○ | ○ | — | 4Kb | 4Kc | 4Kb | 4Kb |
| 11 | — | ○ | — | ○ | 4Kb | 4Kd | 4Kd | 4Kb |
| 12 | — | ○ | — | — | 4Kb | 4Kb | 4Kb | 4Kb |
| 13 | — | — | ○ | ○ | 4Kc | 4Kc | 4Kd | 4Kc |
| 14 | — | — | ○ | — | 4Kc | 4Kc | 4Kc | 4Kc |
| 15 | — | — | — | ○ | 4Kd | 4Kd | 4Kd | 4Kd |

○ : RANK-1 AND PRINT-READY

— : OTHER CATEGORIES THAN THE ABOVE

FIG. 9

SECOND TABLE

| CASE NO. | CURRENT STATUS OF DEVELOPER | | | | LAST DEVELOPER | | | |
|---|---|---|---|---|---|---|---|---|
| | 4Ka | 4Kb | 4Kc | 4Kd | 4Ka | 4Kb | 4Kc | 4Kd |
| 1 | O | O | O | O | 4Kb | 4Kc | 4Kd | 4Ka |
| 2 | O | O | O | — | 4Kb | 4Kc | 4Ka | 4Ka |
| 3 | O | O | — | O | 4Kb | 4Kd | 4Kd | 4Ka |
| 4 | O | O | — | — | 4Kc | 4Kc | 4Ka | 4Ka |
| 5 | O | — | O | O | 4Kc | 4Kc | 4Kd | 4Ka |
| 6 | O | — | O | — | 4Kc | 4Kc | 4Ka | 4Ka |
| 7 | O | — | — | O | 4Kd | 4Kd | 4Kd | 4Ka |
| 8 | O | — | — | — | 4Ka | 4Ka | 4Ka | 4Ka |
| 9 | — | O | O | O | 4Kb | 4Kc | 4Kd | 4Kb |
| 10 | — | O | O | — | 4Kb | 4Kc | 4Kb | 4Kb |
| 11 | — | O | — | O | 4Kb | 4Kd | 4Kd | 4Kb |
| 12 | — | O | — | — | 4Kb | 4Kb | 4Kb | 4Kb |
| 13 | — | — | O | O | 4Kc | 4Kc | 4Kd | 4Kc |
| 14 | — | — | O | — | 4Kc | 4Kc | 4Kc | 4Kc |
| 15 | — | — | — | O | 4Kd | 4Kd | 4Kd | 4Kd |

O : RANK-2 AND PRINT-READY

— : OTHER CATEGORIES THAN THE ABOVE

FIG. 10A : HOME POSITION
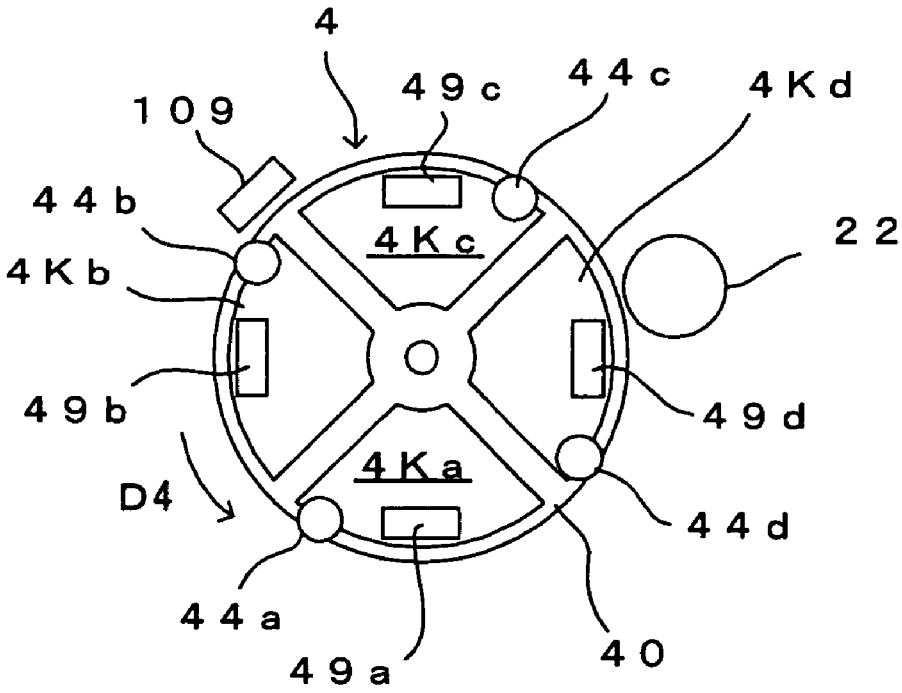
FIG. 10B : IMAGE FORMING POSITION
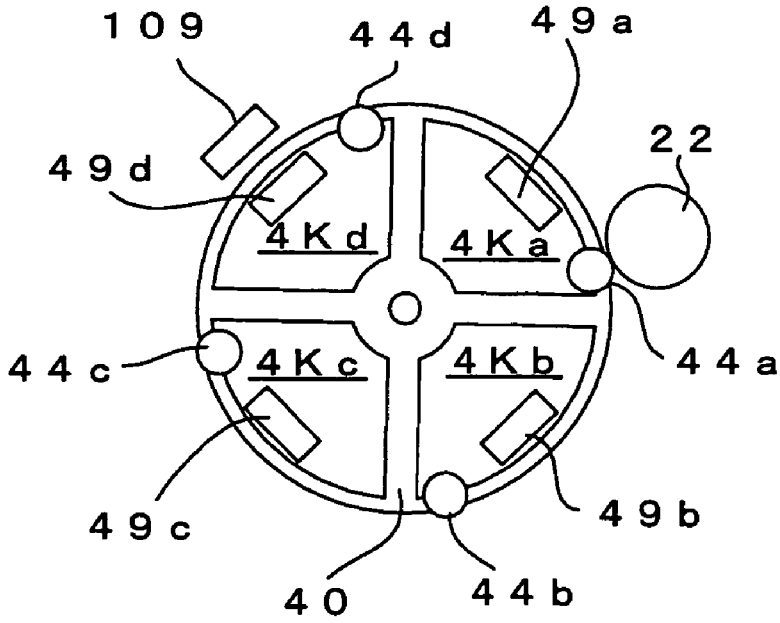

IMAGE FORMING APPARATUS INCLUDING PLURAL DEVELOPERS AND IMAGE FORMING METHOD

CROSS REFERENCE TO RELATED APPLICATION

The disclosure of Japanese Patent Applications enumerated below including specification, drawings and claims is incorporated herein by reference in its entirety:

No. 2005-074690 filed Mar. 16, 2005;

No. 2005-074693 filed Mar. 16, 2005;

No. 2005-085646 filed Mar. 24, 2005; and

No. 2005-085655 filed Mar. 24, 2005.

BACKGROUND

1. Technical Field

The present invention relates to an image forming apparatus including a plurality of developers storing toner therein and an image forming method thereof.

2. Related Art

In electrophotographic image forming apparatus, such as printers, copiers and facsimiles, which form images using toner, a proposal has been made such that plural developers each storing therein a toner of the same color are mounted in the apparatus for use in the apparatus. An image recording apparatus disclosed in JP-A-2003-316106 (equivalent to an "image forming apparatus" herein), for example, is an image recording apparatus which is capable of mounting plural developers, so that the apparatus may be used not only as a color printer when mounted with developers storing therein toners of different colors but also as a monochromatic printer when mounted with developers each storing therein a toner of the same color.

In this image recording apparatus, a developer mounted to a predetermined position is used preferentially. However, when the residual quantity of toner in the developer is decreased to a predetermined level, the developer is switched to another developer. According to another mode of the image recording apparatus, in a case where there are a plural number of usable developers, one of the developers that was mounted at the earliest point in time is used preferentially.

SUMMARY

In the image forming apparatus of this type, when image formation is performed using a developer left unused for a long period of time, it may occur that images formed at an early stage of the image formation are degraded in quality, due to the variation with time of the characteristics of the toner left unused. In the image recording apparatus mentioned in related art, any one of the developers is preferentially used and hence, the other developers are left unused over an extended period of time. When such a developer left unused is used, the aforementioned degradation of image quality is inevitable. Particularly when one developer is switched to another during operation, images formed after the changeover of the developers are significantly varied in quality from images formed before the changeover. This leads to an increased variation of image quality in the eyes of users.

Further, according to the image forming apparatus of this type, since the individual developers store therein the toner of the same color, all formed images should have a constant quality whichever developer is used. In actual fact, however, differences among the statuses of the developers result in the variations of the quality of formed images. In a case where a relatively new developer is mounted together with old developers, in particular, if the new developer is used together with the old developers, significant variations of image quality are encountered.

An advantage of some aspects of the invention is a formation of images of good quality in a stable manner in the image forming apparatus including the plural developers each storing the toner of the same color and in the image forming method thereof.

Further, according to the image forming apparatus mentioned in related art, the order of use of the developers is automatically determined based on the mounting positions in the apparatus and irrespective of the statuses of the individual developers. Such a mode of use of the developers is not always proper in order to form images in good quality and efficiently. When the residual quantity of toner in one of the developers is decreased to a predetermined value so that it is time to switch this developer to another developer, for example, the changeover of developers may sometimes take much time depending on a position of the next developer to be used and hence, the throughput of image formation may be lowered. Furthermore, the image forming apparatus may become unable to maintain the good image quality depending on a status of the succeeding developer. However, such an image forming apparatus has not been well examined as to preferable criteria for selecting a developer to be used for the image forming operation.

An advantage of some aspects of the invention is a formation of images of good quality in a stable manner and efficiently in the image forming apparatus including the plural developers and in the image forming method thereof.

Further, according to the image forming apparatus mentioned in related art, the order of use of the developers is automatically determined based on the mounting positions in the apparatus. Such a mode of use of the developers is not always proper in order to form images in good quality and efficiently. When the residual quantity of toner in one of the developers is decreased to a predetermined value so that it is time to switch this developer to another developer, for example, the changeover of developers may sometimes take much time depending on a position of the next developer to be used and hence, the throughput of image formation may be lowered. Furthermore, the image forming apparatus may become unable to maintain the good image quality depending on a status of the succeeding developer. Further, according to the above apparatus in related art, a particular developer is preferentially used and hence, some of the other developers may be left unused over an extended period of time. As a result, when the developer which is left unused for long is used to form images afterwards, the resultant images may suffer density irregularities.

In the image forming apparatuses of this type, thus, it is necessary to give sufficient consideration to the mode in which the individual developers are to be used. However, such an image forming apparatus has not been well examined as to preferable criteria for selecting a developer to be used for the image forming operation and preferable ways for using the selected developer.

An advantage of some aspects of the invention is a formation of images of good quality in a stable manner and efficiently in the image forming apparatus including the plural developers each storing the toner of the same color and in the image forming method thereof.

According to a first aspect of the invention, there is provided an image forming apparatus comprising: a plurality of developers each of which stores therein a toner of the same color and includes a toner carrier structured to rotate while carrying the toner on its surface; and a controller which executes an image forming operation using the developer in accordance with an image forming command, wherein the controller selects a developer from the plurality of developers based on a length of shutdown time from the end of use in the previous image forming operation and executes the image forming operation using the selected developer.

According to a second aspect of the invention, there is provided an image forming apparatus comprising: a plurality of developers each of which stores therein a toner of the same color; and a controller which executes an image forming operation using any one of the developers selectively, wherein the controller classifies the plurality of developers into quality ranks based on information on the respective operation histories thereof, the quality rank corresponding to an expected image quality when the developer is used in the image forming operation, and varies a mode of the image forming operation according to the classification results.

According to a third aspect of the invention, there is provided an image forming apparatus comprising: a rotary development section which is structured to mount N developers which store a toner therein, wherein N indicates an integer of not less than 3, and to rotate freely about a predetermined rotary axis; and a controller which rotates the rotary development section to selectively position any one of the developers mounted on the rotary development section at a predetermined development position and executes an image forming operation of forming an image with the toner stored in the developer, wherein in a case where M usable developers are mounted in adjoining relation on the rotary development section, wherein M indicates an integer of not less than 2 and less than N, the controller executes the image forming operation while sequentially switching the developers from the one located at the most-downstream-position toward the one located at the most-upstream-position with respect to a rotational direction of the rotary development section.

According to a fourth aspect of the invention, there is provided an image forming apparatus comprising: a positioning unit which is structured to mount a plurality of developers each of which stores therein a toner of the same color and which selectively transfers and positions any one of the plurality of developers at a predetermined development position; and an image forming unit which executes an image forming operation of forming an image on a recording material according to an image forming command from an external source with the toner stored in the developer positioned at the development position, wherein the positioning unit varies a mode of a positioning operation according to contents of the image forming command, the positioning operation performed to transfer and position the developer at the development position.

According to another aspect of the invention, there is provided an image forming method comprising: selecting a developer to use from a plurality of developers, each of which stores therein a toner of the same color and includes a toner carrier structured to rotate while carrying the toner on its surface, based on a length of shutdown time from the end of use in a previous image forming operation; and forming an image corresponding to an image forming command using the selected developer.

According to still another aspect of the invention, there is provided an image forming method comprising: executing an image forming operation using selectively any one of a plurality of developers each of which stores therein a toner of the same color; and classifying the plurality of developers into quality ranks based on information on the respective operation histories thereof, the quality rank corresponding to an expected image quality when the developer is used in an image forming operation, wherein the image forming operation is executed in a mode according to the classification results.

According to still another aspect of the invention, there is provided an image forming method for an image forming apparatus which comprises a rotary development section which is structured to mount N developers which store a toner therein, wherein N indicates an integer of not less than 3, and to rotate freely about a predetermined rotary axis, the method comprising: positioning, at a predetermined development position, M usable developers mounted in adjoining relation on the rotary development section sequentially from the one located at the most-downstream-position toward the one located at the most-upstream-position with respect to a rotational direction of the rotary development section, wherein M indicates an integer of not less than 2 and less than N; and forming an image with the toner stored in the developer positioned at the development position.

According to still another aspect of the invention, there is provided an image forming method for an image forming apparatus which comprises a positioning unit which is structured to mount a plurality of developers each of which stores therein a toner of the same color, the method comprising: transferring and positioning selectively at a predetermined development position any one of the developers mounted on the positioning unit in a mode according to a content of an image forming command from an external source, and executing an image forming operation of forming an image on a recording material according to the image forming command with the toner stored in the developer positioned at the development position.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 8 is a chart showing the first table used for developer selection.

FIG. 9 is a chart showing the second table used for developer selection.

FIGS. 10A and 10B are drawings which show stop positions of the rotary developing unit.

DESCRIPTION OF EXEMPLARY EMBODIMENTS

First Embodiment

Figure 1:
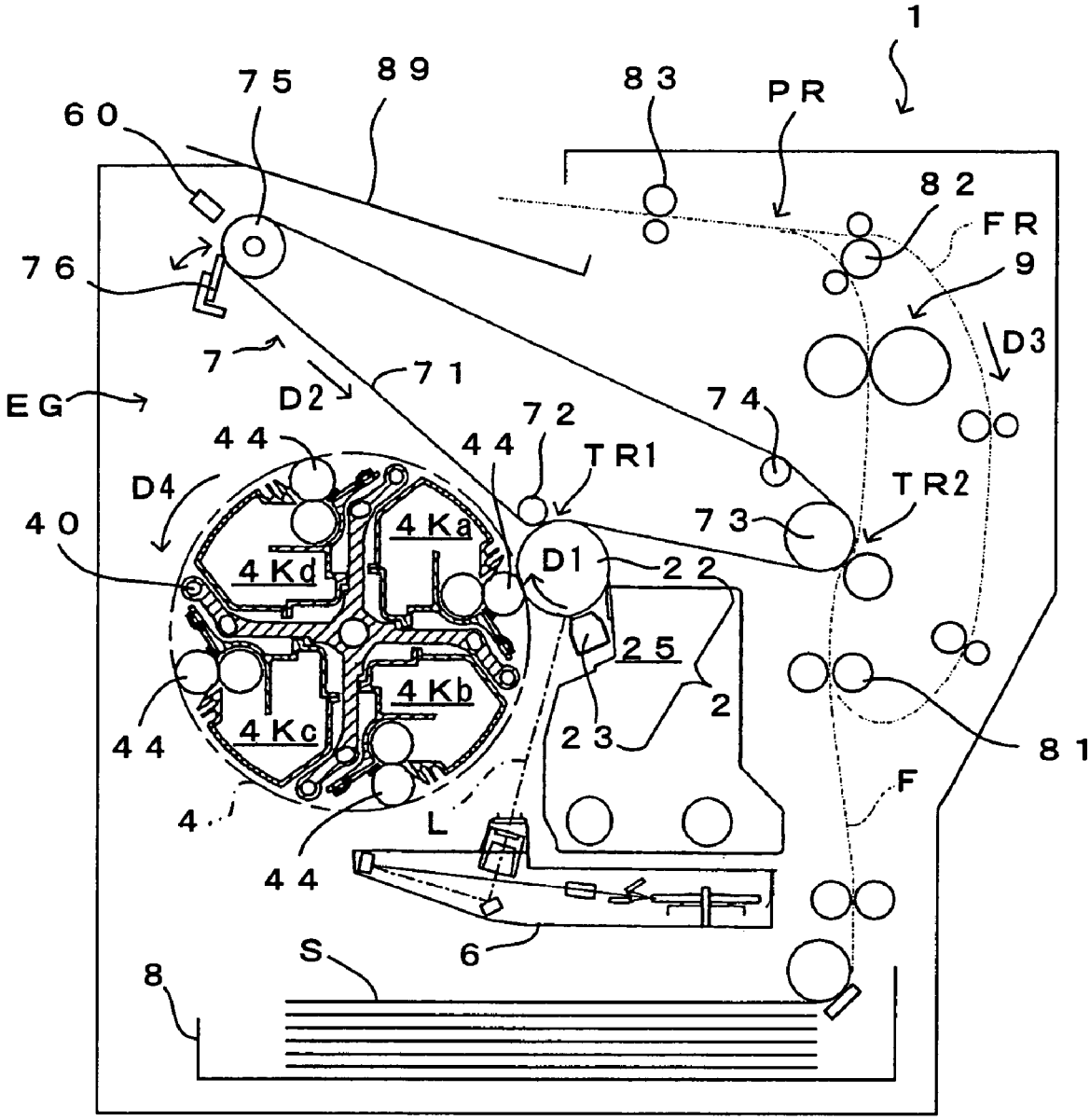
FIG. 1 is a diagram showing an image forming apparatus according to a first embodiment of the invention.
Figure 2:
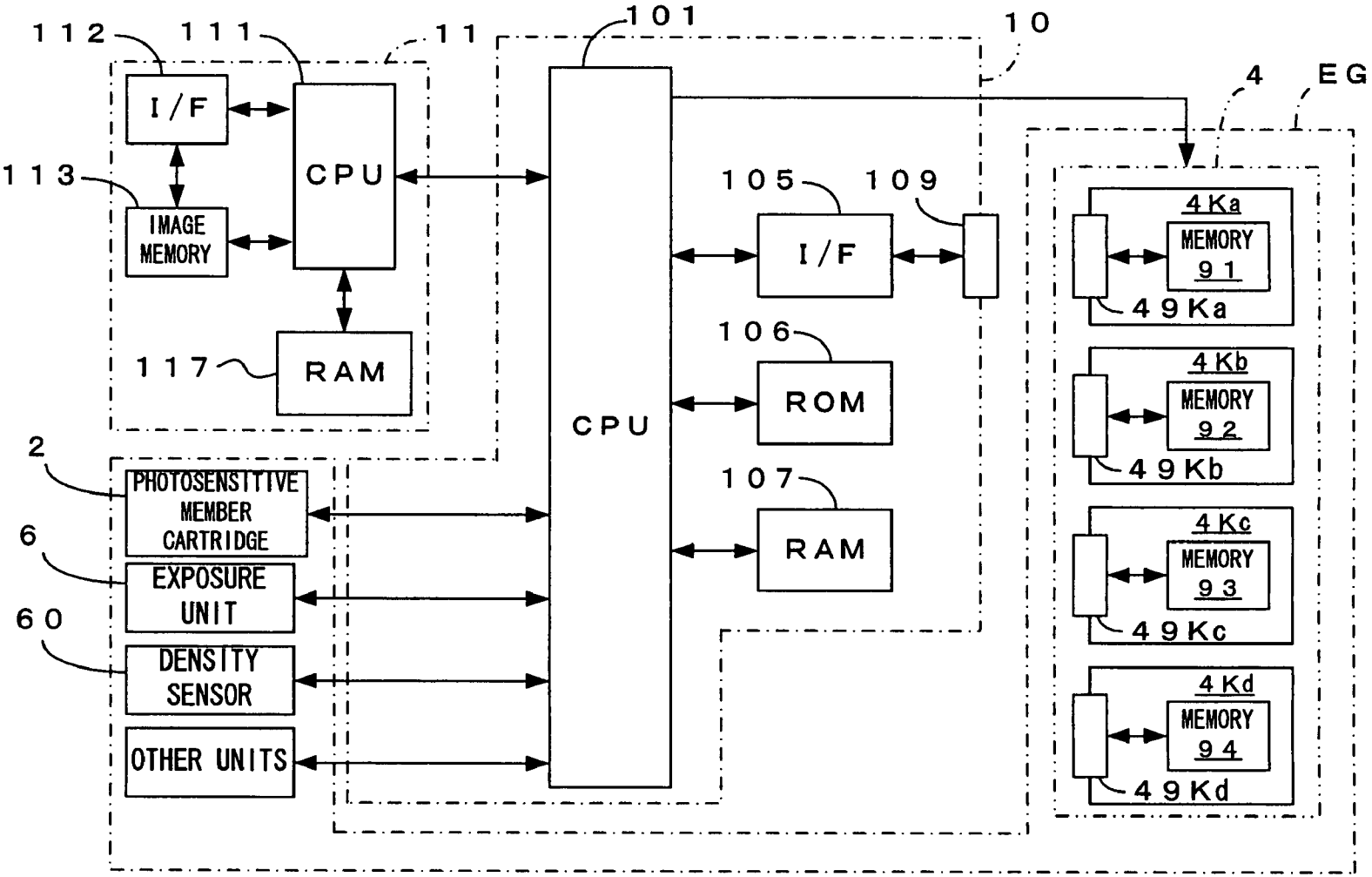
FIG. 2 is a block diagram showing an electrical structure of the image forming apparatus of FIG. 1.

FIG. 1 is a diagram showing an image forming apparatus according to a first embodiment of the invention. FIG. 2 is a block diagram showing an electrical structure of the image forming apparatus of FIG. 1. As will be described hereinlater, the apparatus 1 is an image forming apparatus having four developers mounted therein for forming images. As mounted with the developers individually storing toners of mutually different colors, the apparatus is adapted to form full color images by using these developers and to form monochromatic images by using one of the developers. As mounted with the developers each storing a toner of the same color, the apparatus functions as an image forming apparatus dedicated to the formation of monochromatic images of the toner color. The following description is made on the embodiment wherein the invention is applied to the image forming apparatus dedicated to the monochromatic image formation and mounted with four developers each of which stores therein a black toner.

In the image forming apparatus 1, when an image forming command is fed to a main controller 11 from an external apparatus such as a host computer, an engine controller 10 controls respective portions of an engine part EG in accordance with a command received from the main controller 11 to perform a predetermined image forming operation, and a monochromatic image which corresponds to an image signal fed from the external apparatus is formed on a sheet S.

In the engine part EG, a photosensitive member 22 is disposed so that the photosensitive member 22 freely rotates in the arrow direction D1 shown in FIG. 1. Around the photosensitive member 22, a charger unit 23, a rotary developing unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a used toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from a main body of the apparatus 1 as one integrated unit.

An exposure unit 6 emits a light beam L toward the outer circumferential surface of the photosensitive member 22 which is thus charged by the charger unit 23. The exposure unit 6 makes the light beam L expose on the photosensitive member 22 in accordance with the image signal fed from the external apparatus and forms an electrostatic latent image which corresponds to the image signal.

The developing unit 4 develops thus formed electrostatic latent image with toner. The developing unit 4 comprises a support frame 40 which is disposed for free rotations about a rotation shaft which is perpendicular to the plane of FIG. 1, four developer cartridges 4Ka through 4Kd which house black toner respectively and are formed as cartridges which are freely attachable to and detachable from the support frame 40, and a rotary driver (not shown) which rotates the support frame 40 and the developer cartridges 4Ka through 4Kd as one integrated unit. The engine controller 10 controls the developing unit 4. The developing unit 4 is driven into rotations in a direction D4 shown in FIG. 1 based on a control instruction from the engine controller 10. When the developer cartridges 4Ka through 4Kd are selectively positioned at a predetermined developing position which abuts on the photosensitive member 22 or is away a predetermined gap from the photosensitive member 22, toner is supplied onto the surface of the photosensitive member 22 from a developing roller 44 disposed to the selected developer cartridge. As a result, the electrostatic latent image on the photosensitive member 22 is developed with toner in the developer cartridge which is positioned at the predetermined developing position.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby rotate the intermediate transfer belt. 71 in a predetermined rotation direction D2. In the transfer unit 7, a black toner image formed on the photosensitive member 22 is transferred onto the intermediate transfer belt 71, and is secondarily transferred onto a sheet S unloaded from a cassette 8 one at a time and transported to a secondary transfer region TR2 along a transportation path F.

At this stage, for the purpose of correctly transferring the monochromatic image held by the intermediate transfer belt 71 onto the sheet S at a predetermined position, the timing of feeding the sheet S into the secondary transfer region TR2 is managed. To be more specific, there is a gate roller 81 disposed in front of the secondary transfer region TR2 on the transportation path E As the gate roller 81 rotates in synchronization to the timing of rotations of the intermediate transfer belt 71, the sheet S is fed into the secondary transfer region TR2 at predetermined timing.

Further, the sheet S now bearing the color image is transported to a discharge tray 89, which is disposed to a top surface of the main body of the apparatus, through a fixing unit 9, a pre-discharge roller 82 and a discharge roller 83. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. While the sheet S is returned back to the transportation path F again before arriving at the gate roller 81, the surface of the sheet S which abuts on the intermediate transfer belt 71 in the secondary transfer region TR2 and is to receive a transferred image is at this stage opposite to the surface which already bears the image. In this fashion, it is possible to form images on the both surfaces of the sheet S.

Further, there is a cleaner 76 in the vicinity of the roller 75. The cleaner 76 can be attached to and detached from the intermediate transfer belt 71 driven by an electromagnetic clutch not shown. When abutting on the intermediate transfer belt 71, the cleaner 76 scrapes off the toner remaining on the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 so as to measure, as needed, the density of the toner image formed on the outer circumferential surface of the intermediate transfer belt 71. Based on the measurement results, the apparatus adjusts the operating conditions of the individual parts thereof which affect the image quality. The operating conditions include, for example, a developing bias applied to each developer, the intensity of the light beam L and the like.

The density sensor 60 is structured, by using a reflective photosensor for example, to output a signal corresponding to an image density of a region of a predetermined area on the intermediate transfer belt 71. The CPU 101 is adapted to detect image densities of individual parts of the toner image on the intermediate transfer belt 71 by periodically sampling the output signals from the density sensor 60 while moving the intermediate transfer belt 71 in rotation.

Further, as shown in FIG. 2, the developer cartridges 4Ka through 4Kd are provided with memories 91 through 94, respectively, each memory storing data related to production lots of the developer cartridge, histories of use, the amounts of the remaining toner which is held, and the like. The developer cartridges 4Ka through 4Kd are also provided with wireless communication devices 49Ka, 49Kb, 49Kc, 49Kd, respectively. Whenever necessary, these communication devices selectively perform non-contact data communications with a wireless communication device 109 disposed in the main body. Thus, data transmission and reception via an interface 105 is carried out between the CPU 101 and each of the memories 91 through 94, so that the CPU can manage a variety of information items, such as a consumable article, related to the developer cartridge of interest.

It is to be noted that electromagnetic means such as a wireless communication is used to perform non-contact data communication in this embodiment. An alternative however is to dispose connectors one each to the main body and the developer cartridges and to mechanically engage the connector of the main body with the developer cartridge's connector for mutual data transmission.

In FIG. 2, denoted at 113 is an image memory which is disposed to the main controller 11, so as to store an image which is fed from an external apparatus such as a host computer via an interface 112. Denoted at 117 is a RAM which temporarily stores a calculation result derived by the CPU 111, other data, etc. Denoted at 106 is a ROM which stores a calculation program executed by the CPU 101, control data for control of the engine part EG, etc. Denoted at 107 is a RAM which temporarily stores a calculation result derived by the CPU 101, other data, etc.

The apparatus structured as described above need to determine, based on proper criteria, which of the four developers is to be used before carrying out the image forming operation. The reason is because that in the full-color image forming apparatus, a developer to be used is unambiguously determined based on a color of a toner image to be formed, whereas in the image forming apparatus dedicated for monochromatic-image, there are a plural number of developers storing the toner of the same color.

In this embodiment, the control operation of the engine controller 10 is defined as follows for the purposes of:

(1) forming images of good quality in a consistent manner;
(2) shortening a time period (first print time) between the receipt of the image forming command and the image formation;
(3) increasing the throughput of image formation; and
(4) minimizing the frequency of a preparatory operation (to be described hereinlater) performed on the developer for maintaining the image quality and performing the required preparatory operation efficiently.

Figure 4:
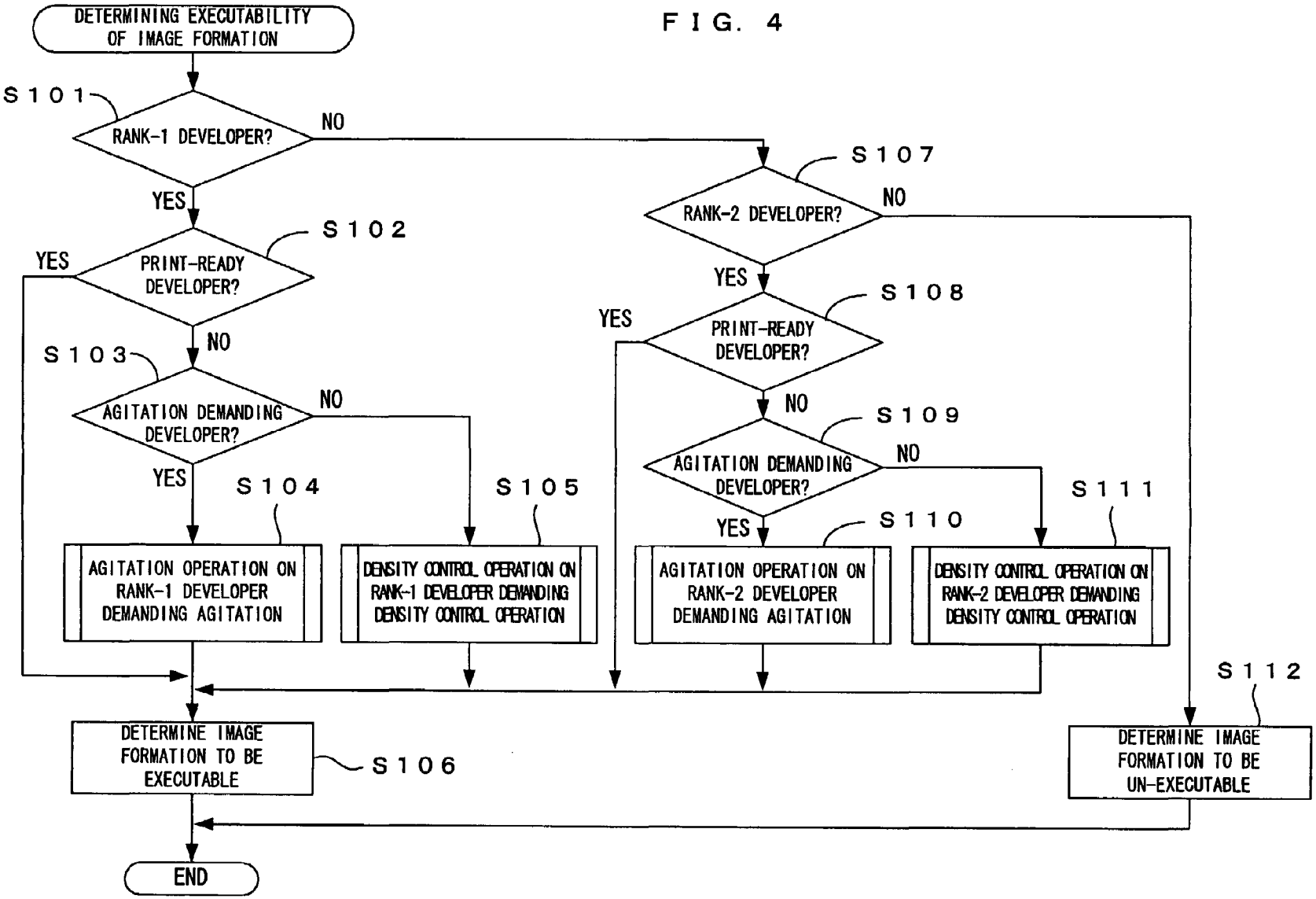
FIG. 4 is a flow chart showing the steps of the process for determining the executability of image formation.

Specifically, the engine controller 10 performs a process, shown in FIG. 4, to determine the executability of image formation on an as-needed basis, the process being to determine whether the apparatus is able to execute the image forming operation promptly or not, by monitoring the respective statuses of the developers. Further, the engine controller 10 maintains the apparatus in a state to be able to execute the image forming operation promptly when the image forming command is fed, by performing, as required, the predetermined preparatory operation (FIGS. 5 and 6) on the respective developers. When an image forming command is fed, the engine controller 10 executes the image forming operation shown in FIG. 7 to form an image corresponding to the image forming command by selectively using an optimum developer from the respective developers. The details of the operations will be described as below.

In this embodiment, the individual developers are classified into life ranks respectively and are judged which life rank they are in respectively, based on the respective residual toner quantities thereof and the respective cumulative time of rotation of the developing rollers 44 disposed therein. The executability of image forming operation is determined based on the judgement result, and the mode of the image forming operation, which will be described hereinlater, is varied accordingly. The grading of the developing devices is described prior to the description of the process to determine the executability of image forming operation.

Figure 3:
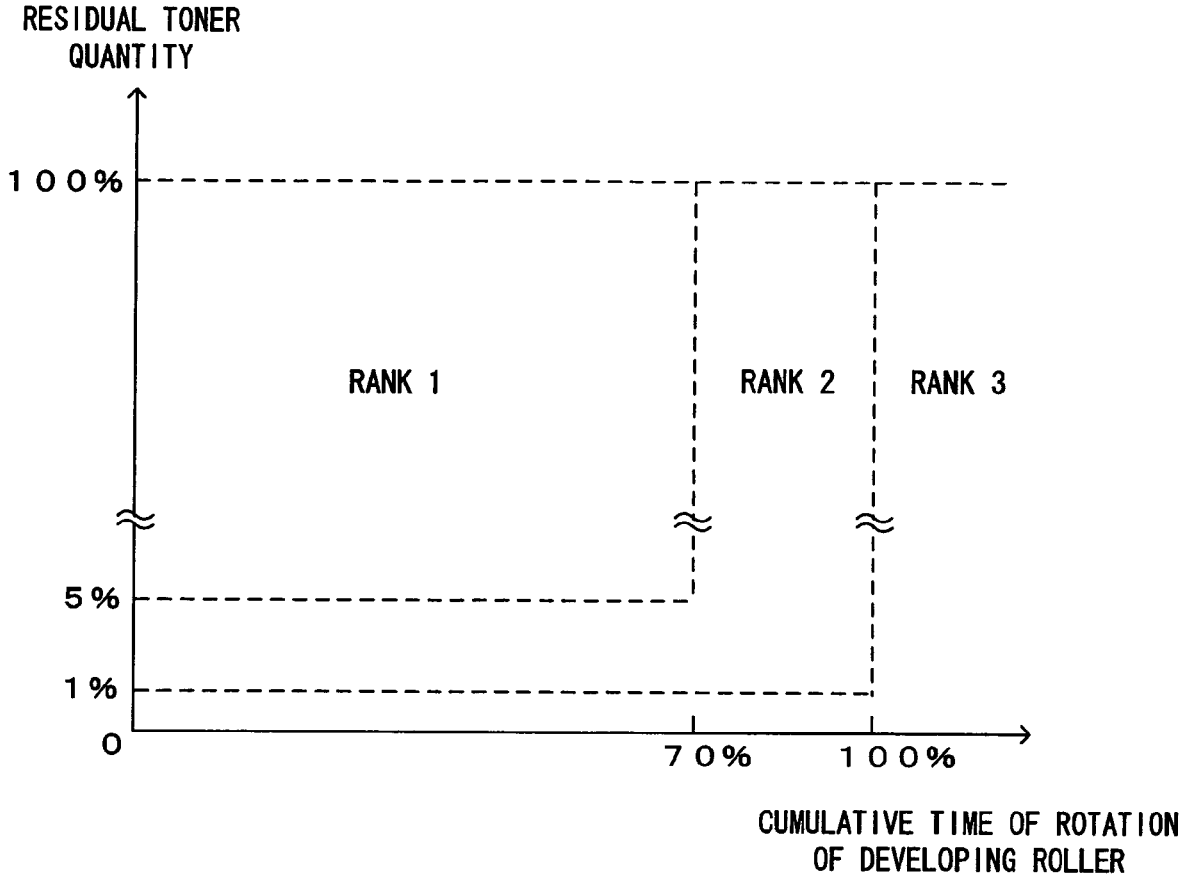
FIG. 3 is a diagram illustrating how the developers are classified into the ranks.

FIG. 3 is a diagram illustrating how the developers are classified into the ranks. The deterioration of image quality attributable to the life of the developer may occur not only when the residual toner quantity becomes low but also when the characteristics of the residual toner is deteriorated. More specifically, if the residual toner quantity is very low, it goes without saying that it is impossible to achieve the good image quality, and even if a sufficient quantity of toner remains in the developer, it is also impossible to achieve the good image quality when the toner in question is deteriorated. The cumulative time of rotation of the developing roller represents the value indicative of the degree of deterioration of the toner. In a case where the cumulative time reaches a predetermined value (10,000 seconds, for example), it is highly likely that the toner is deteriorated even though the amount of remaining toner is enough, and hence, it can be said that the developer in question is improper to use.

According to the embodiment, as shown in FIG. 3, a developer having a residual toner quantity of not less than 5% of the initial toner quantity and having a developing roller of which the cumulative time of rotation is less than 70% of the above-mentioned predetermined value is classified as Rank 1. In a case where images are formed using the Rank-1 developer, the resultant images are expected to have required and sufficient densities without suffering insufficient densities or thin spots, because the developer stores therein a sufficient quantity of toner, and the degree of deterioration of toner stored therein is insignificant. On the other hand, a developer having a residual toner quantity of less than 1% of the initial toner quantity, or a developer having a developing roller of which the cumulative time of rotation is in excess of the above-mentioned predetermined value is classified as Rank 3. The Rank-3 developer is no longer proper to use for the image forming operation. Further, a developer which is placed between these two ranks, that is, a developer having a residual toner quantity of not less than 1% and less than 5% of the initial toner quantity and having a developing roller of which the cumulative time of rotation is less than the above-mentioned predetermined value, or, a developer having a residual toner quantity of not less than 1% of the initial toner quantity and having a developing roller of which the cumulative time of rotation is not less than 70% and less than 100% of the above-mentioned predetermined value, is classified as Rank 2. In a case where images are formed using the Rank-2 developer, the image formation is possible, but there is a possibility to occur image defects such as insufficient density or thin spots. That is, the Rank-2 developer is in a state to be able to form images, the quality of which may possibly be degraded. It is desirable to show the respective ranks of the developers in an unillustrated display to inform a user on an as-needed basis.

As described above, a life rank of a developer is classified into three ranks, that is, Rank 1 ensuring the formation of images of a predetermined quality, Rank 3 indicating that the developer is unusable, and Rank 2 positioned between these two ranks. Hence, the status of the apparatus is divided into any of the following three levels:

(i) a state where the apparatus is mounted with at least one Rank-1 developer, so that the apparatus is able to form images of a required quality by using the Rank-1 developer;

(ii) a state where the apparatus is mounted with no Rank-1 developer and with at least one Rank-2 developer, so that the apparatus is able to form images by using the Rank-2 developer but has a possibility to fail to achieve the required image quality; and (iii) a state where the apparatus is mounted only with the Rank-3 developers, so that the apparatus is no longer able to achieve the required image quality.

Further, even with the Rank-1 or Rank-2 developer, if it is left unused over an extended period of time, a phenomenon that images formed in an initial stage of the image formation subsequently performed suffer periodical density irregularities may occur. The above-mentioned phenomenon is herein referred to as "shutdown-induced banding". Such density irregularities result from the fact that the toner is left carried on the developing roller. It is possible to resolve the density irregularities by rotating the developing roller provided in the developer by a predetermined quantity before the developer is used for the image forming operation. Accordingly, in this embodiment, an operation of rotating the developing roller disposed in each developer by a predetermined quantity is executed on an as-needed basis. The above-mentioned operation is herein referred to as "agitation operation". More specifically, for each of the developers, the length of time that has elapsed since the end of use of the developer in the last performed operation which the above image forming operation or the preparatory operation is counted as a shutdown time. When the shut down time of any one of the developers reaches a predetermined value, a flag associated with the developer of interest is set, indicating that the developer is in need of the agitation operation. The shutdown time may be defined as an elapsed time since the shutoff of the rotation driving of the developing roller 44 in the developer of interest until the present moment. The developer with its flag so set is subjected to the agitation operation in a timing to be described hereinlater, so that the shutdown-induced banding is prevented. The flag is reset when the agitation operation is executed.

Further, as the developer is used longer, the developer is deteriorated more so that the image density varies. Hence, there are some cases that the image forming operation using such a developer may require the alteration of the operating conditions of the individual parts of the apparatus. In this embodiment, therefore, when an information which indicates the above-mentioned life of a developer, that is, either of the residual toner quantity and the cumulative time of rotation of the developing roller, reaches a predetermined threshold, the flag associated with the developer is set indicating the need for an operation of controlling the image density to a predetermined level by re-adjusting the operation conditions of the developer (density control operation). The developer with its flag so set is subjected to the density control operation in a timing to be described hereinlater, whereby the variations of image density are suppressed. The flag is reset when the density control operation is executed.

The aforementioned threshold of the residual toner quantity or the cumulative time of rotation of the developing roller as a trigger of the execution of the density control operation is not limited to one. More specifically, when the residual toner quantity or the cumulative time of rotation of the developing roller reaches a given threshold and the density control operation is executed, a next threshold is newly set. Subsequently, when the residual toner quantity or the cumulative time of rotation of the developing roller reaches the newly-set threshold, the density control operation is executed again. In this manner, the density control operation is repeated plural times during a period between the mounting of one developer in the apparatus and the dismounting thereof following the end of its life. Hence, it is possible to maintain the image quality in a stable manner corresponding to the change in characteristics with time of the developer.

An arrangement may be made such that the information indicative of the status of the developer, such as the residual toner quantity, the cumulative time of rotation of the developing roller and the like, is stored in a storage device disposed in the developer (a non-volatile memory 91 disposed in the developer 4Ka, for example), while the CPU 101 reads/writes the information from/to the storage device as required. With such an arrangement, the information items related with each of the developers accompany each developer itself. Even if the developer is once dismounted from the apparatus and then mounted therein once again or a developer used in another apparatus is mounted in the apparatus, the apparatus is able to manage the respective statuses of the developers properly.

The aforesaid "preparatory operation" is a generic term designating processes and operations performed on a developer prior to its use in the image forming operation in order to bring the developer into a usable condition for the image formation. The agitation operation and density control operation described herein are included in the "preparatory operation".

As described above, in this embodiment, each of the developers is classified into any one of the Ranks 1 to 3 according to the residual toner quantity and the cumulative time of rotation of the developing roller. In addition, the developers of Ranks 1 and 2 are further classified into the following three categories including: one which is ready for use in the image forming operation, that is, which does not demand any preparatory operation (print-ready category); one which demands the agitation operation prior to the image formation (agitation demanding category); and one which demands the density control operation prior to the image formation (density-control demanding category). It is noted, however, that a developer, both of the flags of which are set to demand the agitation operation and the density control operation, is classified into the density-control demanding category. The reason will be described hereinlater.

The process for determining the executability of image formation is performed based on these category classification. The process for determining the executability of image formation and the image forming operation to be described hereinlater are arranged based on the following basic concept. In order to achieve the above object (1) to form the images of good quality in a consistent manner, the apparatus exclusively uses the Rank-1 developer for the image formation so long as at least one Rank-1 developer is available. By doing so, the apparatus is able to form the images of good quality in a consistent manner without the fear of occurrence of insufficient density or thin spots. Since the Rank-2 developer cannot exclude the potential of image defects, the apparatus does not use the Rank-2 developer except when the Rank-1 developer providing the better image quality is no more available.

Further, in a case where there are a plural number of Rank-1 developers, the apparatus selects a first developer to be used each time before starting the image formation. The apparatus uses the individual developers evenly while switching from one developer to another properly. If the developers belong to Rank 1, any of the developers may be used to provide the consistent image quality, so that the image quality variations associated with the switching use of the developers are less. Further, since the individual developers are used evenly, none of the developers is left unused over an extended period of time. Thus, the developer classified into the print-ready category may be prevented from moving into the agitation demanding category. Accordingly, the occurrence of the aforementioned shutdown-induced banding may be obviated and besides, the frequency of the preparatory operation to be performed may be reduced. This also maximizes the period in which the apparatus 1 is in the state to be able to form images. In addition, the development unit 4 is rotated periodically, thus offering an effect to homogenize the toner stored in each of the developers.

If, in this case, at least one of the Rank-1 developers is classified into the print-ready category, the apparatus doe not perform the agitation operation or the density control operation on the other developers. This is because the apparatus is able to form the images of good quality as long as there is one usable developer while the other developers need not necessarily be made usable. Such an approach also meets the aforementioned object (4) to perform the preparatory operation efficiently. On the other hand, when there is no Rank-1 developer belonging to the print-ready category, a predetermined preparatory operation is performed for restoring any of the developers to the usable state. Thus, the apparatus is maintained in the state to be able to continue to form the images of good quality. Further, since any developer un-subjected to the required preparatory operation is not used for the image formation, the formation of an image inferior in quality is obviated. Furthermore, a measure is contrived for reducing time taken by the preparatory operation, as will be described hereinlater.

In a case where the Rank-1 developer is no more available, the apparatus is allowed to continue the image forming operation by using a Rank-2 developer. The toner in the Rank-2 developer is decreased in the residual quantity or somewhat deteriorated in properties. In the image forming operation using this developer, therefore, formed images may be degraded in quality depending upon the degree of decrease of the residual toner quantity or of the deterioration of the toner. In the full-color image forming apparatus, an image defect, such as insufficient density or thin spots, related with one of the toner colors constituting the full-color image appears as a varied color tone of the overall image or color irregularities. In contrast, the apparatus 1 does not entail the problem of color irregularities because the apparatus is dedicated to the monochromatic image formation. In the actual status of the usage of the image forming apparatuses for monochromatic image only, the image forming apparatuses of this type are mostly used for forming character images. In such a usage, some image defect is mostly allowed so long as the printed characters are legible. Therefore, the image forming apparatus for monochromatic image only is thought to have a broader tolerance to the image quality than the full-color image forming apparatus. Hence, in this embodiment, the image forming operation is not inhibited even when the Rank-1 developer is no more available, and the image forming operation by means of the Rank-2 developer is permitted to execute. This approach provides a more effective use of the toner remaining in the developer.

In this case, however, the switching of developers is not performed during the operation of forming a series of images. The reason is as follows. The way that the image defect appears varies according to the status of each developer. If the image formation is performed while switching from one developer to another, the variation of image quality may sometimes be increased depending upon the developer used. Particularly, in a case where images formed using the Rank-1 developer are mixed with images formed using the Rank-2 developer, the image quality variation is increased so that the user may be confused. In this respect, as well, the combined use of the Rank-1 developer and the Rank-2 developer is not favorable. Whether the preparatory operation is to be performed on the Rank-2 developer or not may be determined the same way as in the case of the Rank-1 developer.

It is desirable that the process for determining the executability of image formation is performed not only at a specific time such as immediately after the power-on of the apparatus or receipt of an image forming command, but also during a standby time when the apparatus is waiting for an image forming command from an external source, on an as-needed basis. By doing so, it is possible to cope with the change of the status of the apparatus, the apparatus ever-changing even in the standby time. Since the apparatus is able to perform a required preparatory operation in advance while the apparatus is on standby, when the image forming command is given afterward, the apparatus can start the image forming operation immediately so as to achieve the aforementioned object (2). When the apparatus successively forms a large number of images, it is less likely that a need for the preparatory operation arises in the course of the image forming operation to suspend the image forming operation. Hence, the decrease of the throughput of image formation is obviated and the aforementioned object (3) may be achieved.

FIG. 4 is a flow chart showing the steps of the process for determining the executability of image formation. In this process, determination is first made as to whether the four developers 4Ka to 4Kd include the aforesaid Rank-1 developer or not (Step S101). If at least one Rank-1 developer is included, the operation flow proceeds to Step S102 to determine whether any of the Rank-1 developers is classified into the print-ready category or not. If at least one developer belongs to the print-ready category, the image forming apparatus 1 possesses at least one developer which stores therein a sufficient quantity of toner less deteriorated and which is ready for use. Hence, if the image forming command is applied at this point in time, the apparatus is capable of immediately performing the image forming operation using the developer of interest. In this case, therefore, the operation flow proceeds to Step S106 to determine the apparatus to be capable of executing the image formation. Thus, the process for determining the executability of image formation is completed.

If it is determined in Step S102 that no developer belongs to the print-ready category, the operation flow proceeds to Step S103 to determine whether any of the Rank-1 developers belongs to the agitation demanding category or not. If at least one of the developers belongs to the agitation demanding category, the agitation operation is executed on the developer of interest (Step S104). The process of the agitation operation will be described hereinlater.

If it is determined in Step S103 that none of the developers belongs to the agitation demanding category, the apparatus possesses at least one Rank-1 developer, every one of which belongs to the density-control demanding category. In this case, therefore, the density control operation, which will be described hereinlater, is executed on such a developer or developers (Step S105).

On the other hand, if it is determined in Step S101 that there is no Rank-1 developer, determination is made as to whether there is any Rank-2 developers or not (Step S107). If there is no Rank-2 developer, then the four developers are all classified as Rank 3. In this case, the apparatus is not mounted with any developer usable for the image formation and hence, is determined to be unable to perform the image forming operation (Step S112).

If there is at least one Rank-2 developer, the same process as in the case where the Rank-1 developer(s) exist is performed. Specifically, if any of the Rank-2 developers belongs to the print-ready category, the apparatus is determined to be capable of immediately performing the image formation (Steps S108 and S106). In a case where none of the developers belongs to the print-ready category but any of them belongs to the agitation demanding category, the agitation operation is performed on the developer of interest (Steps S109 and S110). If there is only a developer belonging to the density-control demanding category, the density control operation is performed on the developer (Step S111) before the apparatus is determined to be able to perform the image formation (Step S106).

Figure 5:
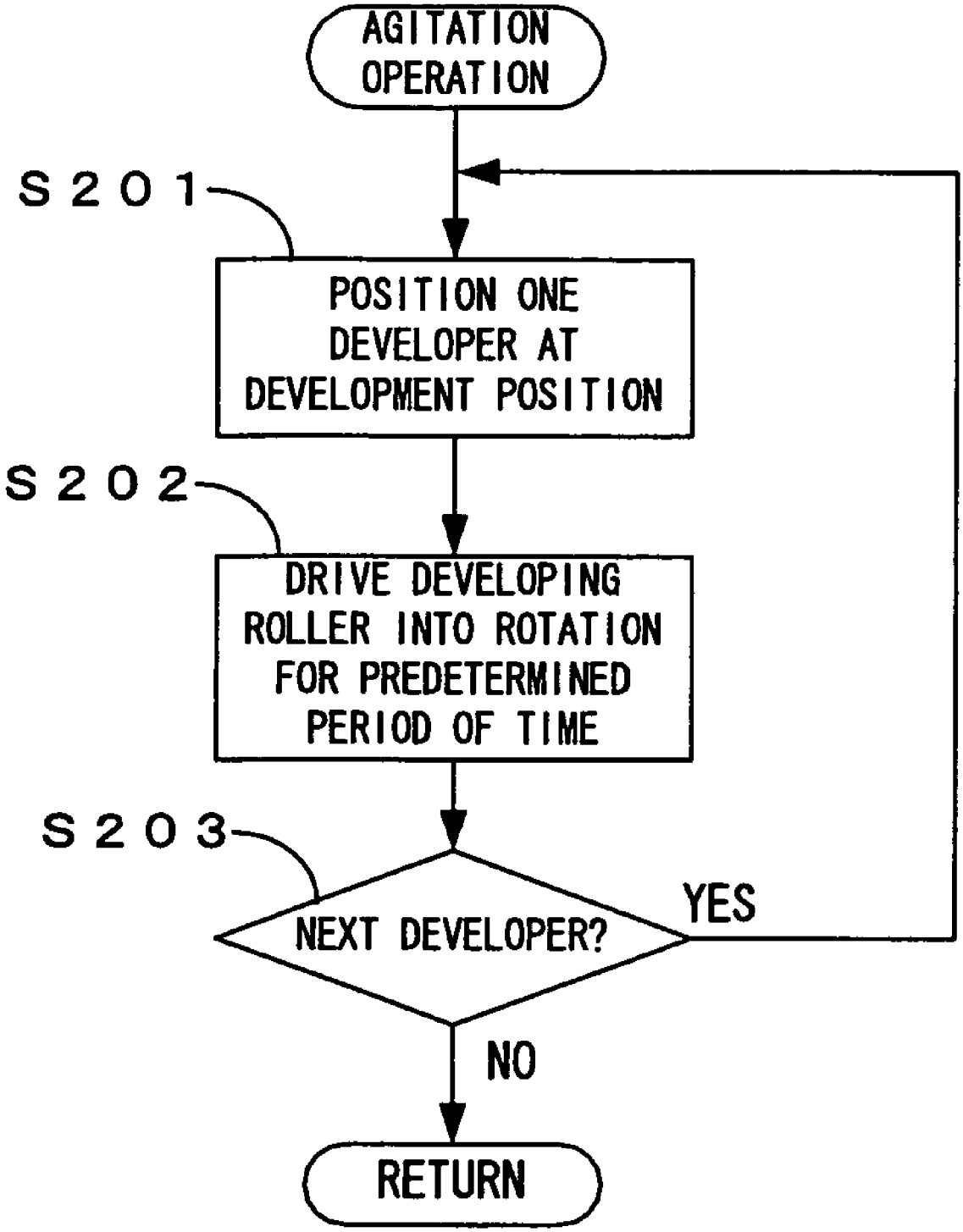
FIG. 5 is a flow chart showing the steps of the agitation operation.

FIG. 5 is a flow chart showing the steps of the agitation operation. In the agitation operation, one of the developers in the agitation demanding category is first positioned at the development position facing the photosensitive member 22 (Step S201). Subsequently, the developing roller 44 disposed in the developer is driven into rotation for a predetermined period of time (Step S202). At this time, the developing bias is not applied in order to prevent toner from scattering from the developing roller 44. By performing the operation, the shutdown-induced banding resulting from the long standstill state of the developing roller is eliminated. Thus, the developer is brought into the state to be usable for the image forming operation or into the print-ready category. In a case where there is the next developer to be subjected to the agitation operation, the aforementioned process is repeated, whereas if there is no other developer to be subjected to the operation, the process is terminated (Step S203).

It is noted that in this embodiment, out of the developers in the agitation demanding category, those which belong to the same rank are successively subjected to the agitation operation. In Step S106 shown in FIG. 4, the agitation operation is performed exclusively on the developer which is classified as Rank 1 and demands the agitation operation. Even if there is a developer which is classified as Rank 2 and demands the agitation operation, this developer is not subjected to the agitation operation at this point in time. As described above, in this embodiment, images are formed by using the Rank-1 developer if it is available. Therefore, it is unnecessary to subject the Rank-2 developer to the agitation operation at this point in time. Such an approach omits an unnecessary preparatory operation and shortens a process time taken to shift the apparatus to a state to be able to perform the image forming operation, thus contributing to the achievement of the aforementioned objects (2) to (4).

Further, a developer, the "agitation demanding" flag and the "density-control demanding" flag of which are both set, is classified into the density-control demanding category and hence, the agitation operation is not performed on this developer at this point in time. The reason is as follows. As will be described hereinlater, the agitation operation constitutes a part of the density control operation and hence, the agitation operation is automatically performed when the density control operation is performed. Therefore, it is unnecessary to perform the agitation operation and the density control operation discretely on the developer demanding both the agitation operation and the density control operation, only the density control operation may be performed on such a developer. Conversely, if a developer demanding the density control operation is only subjected to the agitation operation, the developer does not become ready to print. What is more, the density control operation takes a longer process time than the agitation operation. Hence, at this point in time that there is the developer which can be brought into the print-ready category only by performing the agitation operation, it is preferable to perform only the agitation operation on such a developer in order to achieve the aforementioned objects (2) and (3).

Figure 6:
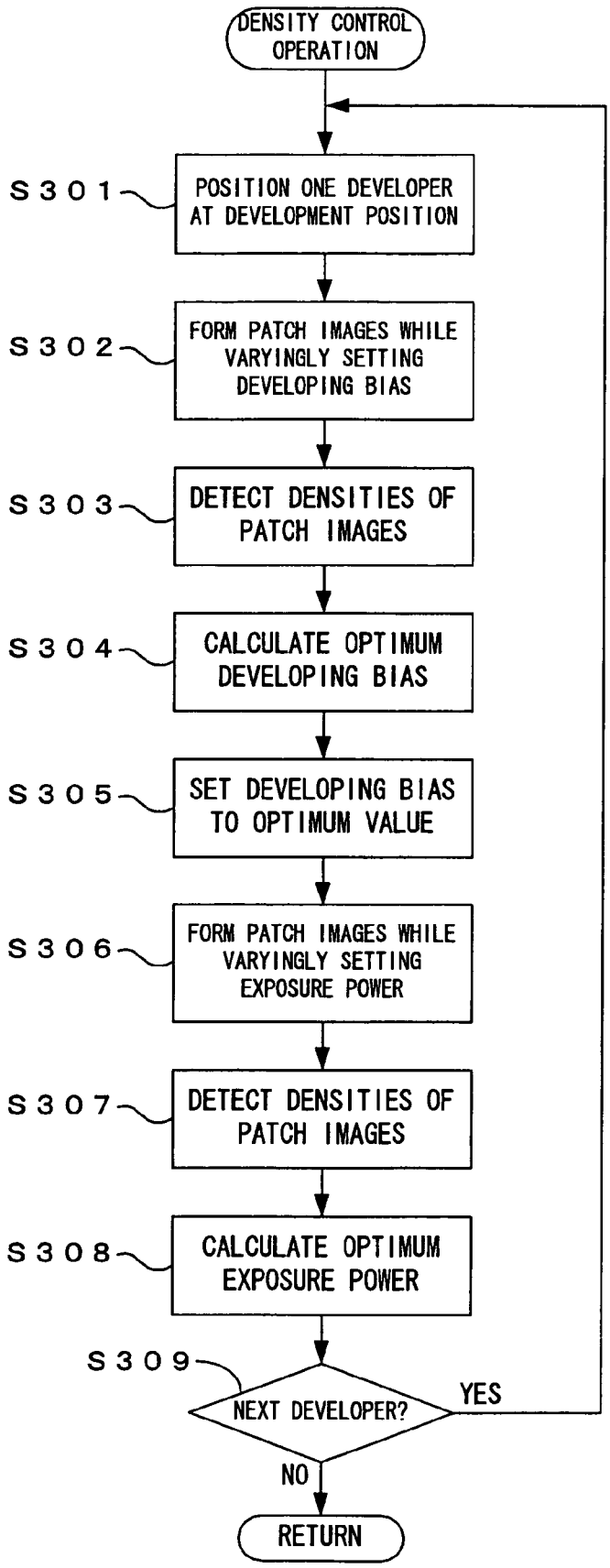
FIG. 6 is a flow chart showing the steps of the density control operation.

FIG. 6 is a flow chart showing the steps of the density control operation. The density control operation is a process performed to maintain a consistent quality of images formed by the image forming operation. In this process, patch images are formed while setting the operating conditions of the individual parts of the apparatus in various values, and the densities of the patch images are detected respectively. And then, the operating conditions are adjusted based on the detection results. In this process, among the operation parameters defining the operating conditions of the individual parts of the apparatus, as control factors affecting the image quality, the developing bias and an exposure power are adjusted. As operation parameters functioning as the control factor, there are many others except these, and as to the principles and methods of controlling the image quality based on these parameters also, a large number of techniques are known. Since these techniques are also applicable to the embodiments hereof, a brief description is made here only on the flow of the process.

First, one of the developers in the density-control demanding category is positioned at the development position facing the photosensitive member 22 (Step S301). Subsequently, while the developing bias applied to the aforesaid developer is varied in multiple steps, each of the patch images of a predetermined pattern, such as solid image, is formed at each of the varied bias values (Step S302). The densities of the patch images are detected by the density sensor 60 (Step S303). An optimum value of the developing bias, which makes the patch images have a predetermined target density, is calculated based on the detection results (Step S304).

Next, the adjustment of the exposure power is performed. The developing bias is set to the optimum value determined in the aforementioned manner (Step S305). Half-toned images, as patch images, are formed while varying the exposure power in multiple steps (Step S306). The densities of the resultant patch images are detected by the density sensor 60 (Step S307). An optimum value of the exposure power, which makes the patch images have the predetermined target density, is calculated based on the detection results (Step S308).

As to the developer thus the density control operation has been performed, while the optimum developing bias and exposure power for the developer are determined, the shut-down-induced banding is resolved because the developing roller 44 is driven into rotation during the formation of the patch images. Thus, the developer is shifted from the density-control demanding category to the print-ready category which means that the developer is ready for use in the subsequent image forming operation. Subsequently, if there is the next developer to be subjected to the density control operation, the aforementioned process is repeated, whereas if there is no other developer to be subjected to the density control operation, the process is terminated (Step S309).

By performing the aforementioned process for determining the executability of image formation, in the apparatus 1, it is determined whether the apparatus is in the state to be able to execute the image forming operation or not. As required, the predetermined preparatory operation is performed on a developer demanding such an operation, so that the apparatus may be maintained in the state to be able to form images so long as at least one Rank-1 or Rank-2 developer is mounted therein. When an image forming command is applied from an external apparatus, the apparatus is capable of immediately starting the image forming operation according to the command. In a case where all the developers are classified as Rank 3, on the other hand, the apparatus is determined to be unable to perform the image forming operation, hence, the formation of images of inferior quality is obviated. In the case that it is impossible to perform the image formation, the apparatus informs the user to that effect and stops receiving the image forming command from the external source.

Figure 7:
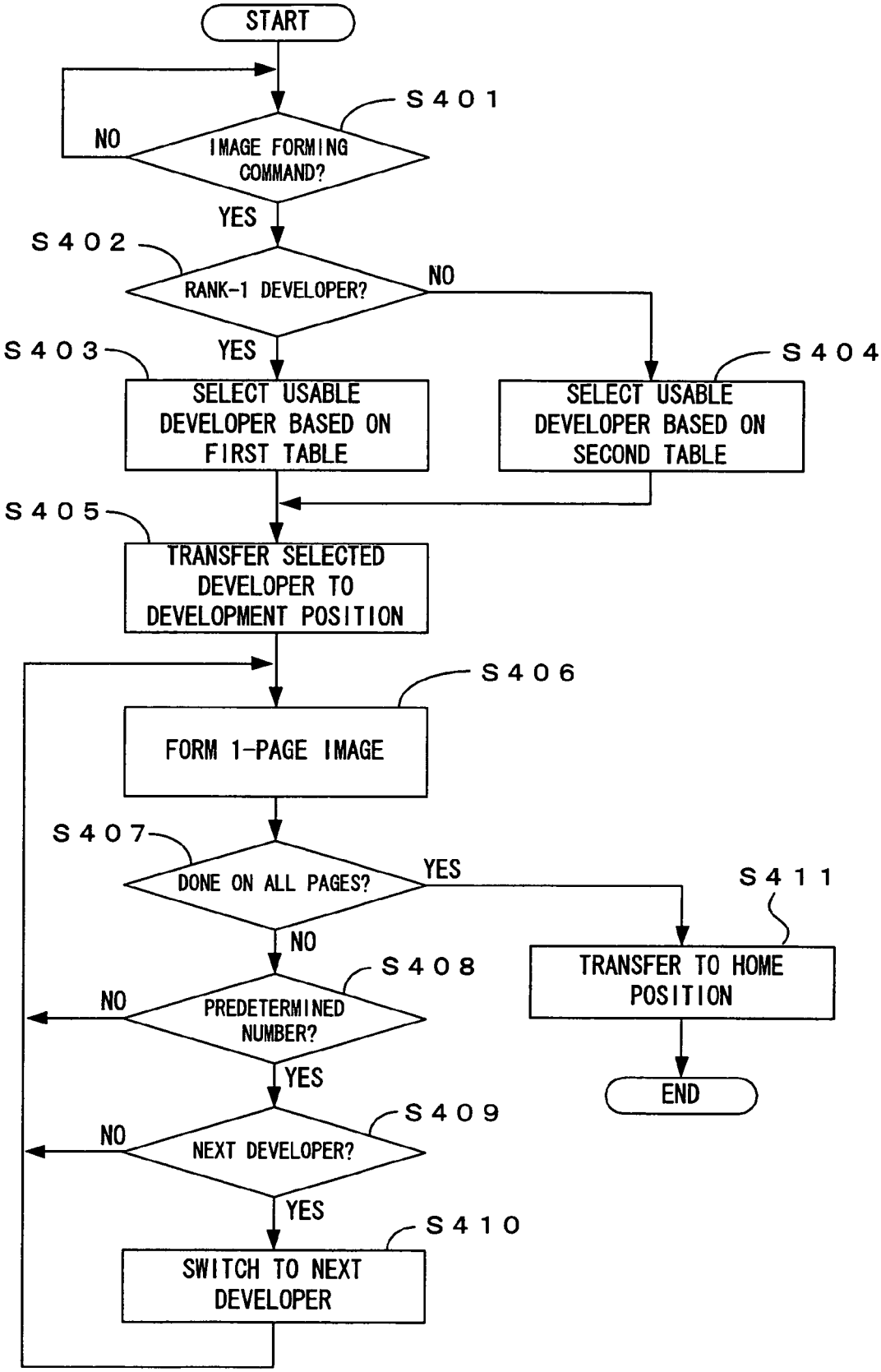
FIG. 7 is a flow chart showing the steps of the image forming operation.

FIG. 7 is a flow chart showing the steps of the image forming operation. If it is determined in the process for determining the executability of image formation that the apparatus is in the state to be able to form images, the apparatus is in a standby condition pending the receipt of the image forming command from the external source (Step S401). When the image forming command is applied, determination is first made as to whether any Rank-1 developer is available or not (Step S402). If there is at least one Rank-1 developer, the apparatus refers to a first table (FIG. 8), which will be described hereinlater, so as to select a developer to be used (Step S403). Whereas, if there is no Rank-1 developer, the apparatus refers to a second table (FIG. 9), which will be described hereinlater, so as to select a developer to be used (Step S404). In this embodiment, the next developer to be used is selected based on a combination of the current statuses of the developers (ranks and categories) and a last-used developer in the preceding image forming operation (hereinafter, simply referred to as "last developer").

FIG. 8 is a chart showing the first table used for developer selection. In a case where the apparatus is mounted with the Rank-1 developer(s) and is able to form images, there should be at least one developer classified as Rank 1 and in the print-ready category. Such a developer is used for the image forming operation. If there is only one relevant developer, this developer is used. If there are plural relevant developers, the next developer to be used is selected based on the last developer. More specifically, out of the plural relevant developers, one which is located upstream from the last developer with respect to the rotational direction of the rotary development unit 4 and closest to the last developer is used in the next image forming operation.

In a case where all the four developers are classified as Rank-1 and in the print-ready category, for example (Case No. 1 in FIG. 8), if the developer 4Ka is the last developer, the developer 4Kb located at one place upstream therefrom is used in the next image forming operation. Likewise, if the developer 4Kb, 4Kc or 4Kd is the last developer, the developer 4Kc, 4Kd or 4Ka mounted to place adjacent to and upstream from the last developer is used. In a case where only the developer 4Kb, out of the four developers, does not satisfy the above requirements (Rank-1 and print-ready category), for example (Case No. 5 in FIG. 8), any one of the developers 4Ka, 4Kc and 4Kd satisfying the requirements is selected. If, in this case, the developer 4Ka or 4Kb is the last developer, the developer 4Kc located closest to and upstream from the developer in question is used. In the other cases, the developer to be used may be selected in a similar manner.

By selecting the developer to be used in this manner, in a case where there are plural Rank-1 developers, the developer to be used for image formation is changed each time. Thus, any of the developers is prevented from being left unused over an extended period of time.

FIG. 9 is a chart showing the second table used for developer selection. In the second table which is used when there is no Rank-1 developer, as well, a developer to be used is selected the same way as when the first table is used. That is, the developer is selected based on the current statuses of the developers and the last developer. It is noted, however, that the next developer to be used is selected from the developers classified as Rank-2 and in the print-ready category.

Returning to FIG. 7, the image forming operation is further described. After the developer is selected in the aforementioned manner, the selected developer is transferred and positioned at the development position facing the photosensitive member 22 (Step S405). The developer so positioned is used for forming the first-page image of the images corresponding to the image forming command (Step S406). If this image is what to be formed (Step S407), the development unit 4 is transferred to a home position (Step S411) to terminate the image forming operation.

In a case where there is the next image to be formed, on the other hand, the operation is continued to form the next image. Prior to the formation of the next image, determination is made as to whether the number of images successively formed by the in-use developer has reached a predetermined number or not (Step S408). If the predetermined number (defined as 8 in this embodiment) is not reached, the operation flow returns to Step S406 to form the next image. If the predetermined number is reached, determination is made as to whether the next developer to be switched to use is available or not (Step S409). If there is the next usable developer, the rotary development unit 4 is rotated 90 degrees to position the next developer at the development position (Step S410). If the next developer is not available, the operation flow returns to Step S406 with the in-use developer remaining at the development position, so as to form the next image.

Criteria for the determination in Step S409 are as follows. If a developer adjacent to and upstream from an in-use developer with respect to the rotational direction of the development unit 4 is classified as Rank 1 and in the print-ready category, the adjoining developer may be used as the next one. A determination result in this case is "YES". In all the other cases than this, a determination result is "NO". For instance, if the developer 4Ka is in use whereas the developer 4Kb adjacent thereto and upstream therefrom is classified as Rank 1 and in the print-ready category, the result of determination in Step S409 is "YES". On the other hand, if the developer 4Kb adjacent to and upstream from the in-use developer 4Ka is not classified as Rank 1 and in the print-ready category, the result of determination in Step S409 is "NO" even though there is another developer classified as Rank 1 and in the print-ready category.

If a developer classified as Rank 1 and in the print-ready category is located adjacent to and upstream from the in-use developer, another Rank-1 developer in the print-ready category may be transferred to the development position simply by rotating the development unit 4 by 90 degrees. Hence, the changeover of developers may be accomplished without lowering the throughput of image formation. Furthermore, the image quality may be maintained well because the next developer to be used is classified as Rank 1 and in the print-ready category.

The following effects may be obtained by making the changeover of developers during the operation of forming a series of images. If the apparatus continues to use one of the developers, the developer entails a progressive degradation of image quality because the toner around the developing roller is increased in the proportion of stale toner. In the meantime, the other developers are prone to the shutdown-induced banding because the respective developing rollers thereof are left standstill while carrying the toner on their surfaces. However, when the development unit 4 is rotated to switch from one developer to another, the toner in the developers is agitated and homogenized so that the apparatus may maintain the good image quality. In addition, one of the developers is prevented from being used disproportionately long, whereby the individual developers are prevented from producing the shutdown-induced banding.

On the other hand, in a case where the developer adjacent to and upstream from the in-use developer is classified as any other usefulness rank than Rank 1 or classified in any other category than the print-ready category, the image formation performed using such a developer potentially involves a fear of significant image quality variations following the changeover of developers. Even though there is a Rank-1 developer of the print-ready category at place other than that adjacent to and upstream from the in-use developer, the development unit 4 must be rotated 180 degrees or more to switch the in-use developer to the usable developer. Hence, the changeover takes so much time that the throughput is lowered. In these cases, therefore, the apparatus does not make the changeover of developers, continuing to use the in-use developer.

When an image forming operation corresponding to a new image forming command is performed after the completion of the operation of forming a series of images, the selection of a developer is performed anew. In cases, the preparatory operation may be performed during the standby time pending a new image forming command so that any of the developers may be shifted to the print-ready category. Accordingly, it is possible for a developer not used in the previous image forming operation to be selectively used in the subsequent image forming operation.

Thus, in the image forming operation according to the embodiment, a developer to be used in the next operation is determined based on the current statuses of the individual developers and on the last-used developer in the previous image forming operation. What is more, in a case where there are a plural number of usable developers, these developers are used while being switched from one developer to another. Thus, all the usable developers are used in turn, so that one of the developers is prevented from being used disproportionately long.

The developer to be used for image formation is selected based on the aforementioned criteria. In the execution of the image forming operation, therefore, one developer having the longest shutdown time between the end of use in the last image forming operation or preparatory operation and the current point of time is selected from the developers in the print-ready category and is used. As described above, the developer is more prone to the shutdown-induced banding as the shutdown time thereof increases. As suggested by the embodiment, however, one developer having the longest shutdown time is selected from the developers usable in the image forming operation and is used in the subsequent image forming operation. Hence, the shutdown-induced banding, which results from that the developer is left standstill further longer, may be obviated.

Let us consider a case where, for example, all the developers are classified as Rank 1 and in the print-ready category while image data representing 20-page images are applied as the first image forming command. If the image forming operation is started using the developer 4Ka, for example, the developer 4Ka is switched to the developer 4Kb at the point in time that a set of 8-page images have been formed by means of the developer 4Ka. Then, the developer 4Kb is switched to the developer 4Kc at the point in time that another set of 8-page images have been formed. Subsequently, the remaining 4-page images are formed by means of the developer 4Kc and the operation of forming the series of images is completed. When a new image forming command is applied afterwards, the apparatus refers to the first table (FIG. 8) and determines to use the developer 4Kd in the execution of the next image forming operation. The developer 4Kd has the longest non-operation time (shutdown time) among the four developers.

It is assumed that the previous image forming operation reduced the residual quantity of toner in the developer 4Ka so that the developer 4Ka is moved into Rank 2 at this point in time. In this case, the developer 4kd is not switched to the developer 4Ka or to the developer 4Kb. That is, the apparatus continues to use the developer 4Kd in the subsequent operation of forming a series of images. When next image forming command is applied further, the apparatus refers to the first table (FIG. 8). Since this case falls under Case No. 9 and the last-used developer is the developer 4Kd, the developer 4Kb is selected from the Rank-1 developers 4Kb, 4Kc, 4Kd in the print-ready category and is used in the subsequent image forming operation. The developer 4Kb has the longest shutdown time from last use among the three usable developers.

Thus, in this embodiment, it is basically arranged to use the individual developers while switching in the rotational direction of the development unit 4 and to select the next developer based on the positional relation between/among the usable developers mounted on the development unit 4 and based on the last-used developer in the previous image forming operation or preparatory operation. In other words, the first and second tables are prepared such that one developer having the longest shutdown time may be selected from the usable developers based on the information indicative of the statuses of the individual developers and of the last-used developer. Such tables permit the developer having the longest shutdown time to be selected, even though measurement is not taken on the respective shutdown times of the developers.

According to this embodiment as described above, in the image forming apparatus dedicated for monochromatic image, which is mounted with the four developers each storing therein the black toner, performs the process for determining the executability of image formation (FIG. 4) on an as-needed basis, so as to monitor the statuses of the individual developers. Based on the result of the above process, the apparatus determines whether the apparatus is able to execute the image forming operation or not. The apparatus performs the predetermined preparatory operation as required, thereby maintaining, as much as possible, the apparatus in the state to be able to execute the image forming operation. Specifically, the apparatus is determined to be able to perform the image forming operation if there is at least one developer, the life of which is classified as Rank 1 indicating that the developer is relatively fresh, and which may be directly used in the image forming operation without being subjected to the preparatory operation. In this state, the apparatus is able to start the image forming operation immediately after the receipt of the image forming command.

In a case where there is a Rank-1 developer which is in a state demanding the preparatory operation, the required preparatory operation is performed to shift the developer to the usable state. If, in this case, a developer made usable by the agitation operation, which is completed in a shorter time, and a developer demanding the density control operation, which takes a longer process time, are both in existence, only the agitation operation is performed on the developer(s) demanding it. Thus, the process time of the preparatory operation may be shortened so that the apparatus may be quickly restored to the state to be able to perform the image forming operation. Further, even when there arises a developer which demands the preparatory operation, the preparatory operation is not performed at the point in time if at least one of the other developers is usable, but the preparatory operation which is minimum required is performed at the point in time that none of the developers are usable any more. Thus, according to the process for determining the executability of image formation in this embodiment, it is possible to maintain the apparatus in the state to be able to perform the image forming operation as much as possible, and besides, to execute the preparatory operation efficiently omitting the unnecessary preparatory operation.

The preparatory operation includes the agitation operation and the density control operation, either one of which is enabled and executed whenever needed. The agitation operation is performed on a developer of which the shutdown time from last use exceeds the predetermined value. In the agitation operation, the developing roller disposed in the aforesaid developer is rotated by the predetermined amount, thereby eliminating the shutdown-induced banding. The density control operation is performed on a developer of which the residual toner quantity or the cumulative time of rotation of the developing roller reaches the predetermined value. In the density control operation, the operating conditions of the apparatus in using the aforesaid developer. Further, in a case where a developer demanding the agitation operation and a developer demanding the density control operation are both in existence, only the agitation operation which takes the shorter process time is executed. Hence, it is possible to shorten a period of time during which the image forming operation is disabled due to the execution of the preparatory operation.

In a case where there is no Rank-1 developer but there are some Rank-2 developers with the toner slightly deteriorated, the apparatus is also determined to be ready for the image forming operation, the determination is made immediately when there is a developer ready to use, whereas the determination is made after the necessary preparatory operation is performed when there is a developer which demands some preparatory operation. Accordingly, the image formation may be performed using the toner in the developer effectively.

In the image forming operation according to the embodiment, a developer to be used is selected based on the respective statuses of the developers and the last-used developer in the previous operation, and then the image is formed using the developer thus selected. Hence, a developer in the best condition is always selected and used to form images, thereby enabling to form images of good quality consistently in this embodiment. Specifically, one developer having the longest shutdown time from last use is selected from the developers which are ready to use. Further, in a case where there are a plural number of developers classified as Rank 1 and in the print-ready category, the image formation is performed while switching from one developer to another. This prevents one of the developers from being used disproportionately long and hence, prevents a certain developer from being left unused over an extended period of time. As a result, in this embodiment, the image quality variations are prevented by suppressing the occurrence of density irregularities which are encountered when a developer left unused for long is used, that is, shutdown-induced banding. In addition, the frequency of the execution of the preparatory operation which is for the prevention of the banding is minimized.

Further, the changeover of developers during the image formation is not performed when the Rank-2 developer is used. Hence, the variation of the image quality resulting from the use of developers in a different status does not occur.

According to the embodiment, by performing the process for determining the executability of image formation, the apparatus is always maintained in the state to be ready for the image forming operation, thereby being capable of immediately performing the image forming operation when the image forming command is actually applied. Hence, in the image forming operation of this embodiment, it is possible to form images in a short first print time. Further, since the frequency of the execution of the preparatory operation is reduced, the decrease of throughput of image formation, which results from the execution of the preparatory operation during the image forming operation, may be minimized.

As described above, in this embodiment, the engine controller 10 functions as a "controller" of the first aspect of the invention, and the developing roller 44 disposed in the respective developers functions as a "toner carrier" of the first aspect of the invention. Further, in this embodiment, that the developer is classified as Rank 1 and in the print-ready category is equivalent to the "usability requirement" of the first aspect of the invention.

Further, in this embodiment, the engine controller 10 functions as a "controller" of a second aspect of the invention, and the rotary development unit 4 functions as a "positioning unit" of the second aspect of the invention. Further, in this embodiment, the position at which the developer faces the photosensitive member 22, that is, the position of the developer 4Ka as seen in FIG. 1, is equivalent to a "development position" of the second aspect of the invention. Whereas, the position adjacent to and 90 degrees upstream from the development position with respect to the rotational direction of the development unit 4, that is, the position of the developer 4Kb as seen in FIG. 1, is equivalent to a "standby position" of the second aspect of the invention. Further, the life ranks 1 and 2 of this embodiment are equivalent to "first and second quality ranks" of the second aspect of the invention respectively. Furthermore, in this embodiment, both of the residual toner quantity and the cumulative time of rotation of the developing roller of each developer are equivalent to "information on operation history of developer" in the second aspect of the invention.

Second Embodiment

An apparatus according to the second embodiment of the invention has the same construction and electrical structure as those of the first embodiment described with reference to FIGS. 1 and 2. The following description on the second embodiment hereof will focus on differences from the first embodiment.

In this embodiment, the individual developers are used in turn along the rotational direction D4 of the rotary development unit 4. As required, an in-use developer is switched to a developer located one place upstream therefrom and the developer so switched is used. Hence, the changeover of developers during the image forming operation is accomplished simply by rotating the rotary development unit 4 by 90 degrees in the rotational direction thereof. However, which of the developers is to be used first is previously determined. In this embodiment, the developer 4Ka is the first to be used, but the invention is not limited to this.

FIGS. 10A and 10B are drawings which show stop positions of the rotary developing unit. The rotary developing unit 4 is structured to stop at a home position shown in FIG. 10A and at an image forming position shown in FIG. 10B. It is noted that the image forming position in FIG. 10B is one example. In reality, there are four image forming positions which are apart by 90 degrees from each other for the four developers. The home position is a stand-by position of the rotary developing unit 4 when an image signal is not fed to the apparatus. At this home position, as shown in FIG. 10A, developing rollers 44*a*, 44*b*, 44*c* and 44*d* disposed in the respective developers are all away from the photosensitive member 22.

In the condition that the rotary developing unit 4 is in a halt at the image forming position, the developing roller 44*a* disposed in one of the developers (which is the developer 4Ka in the example in FIG. 10B) is opposed against the photosensitive member 22. In this condition, it is possible to visualize an electrostatic latent image formed on the surface of the photosensitive member 22 with the toner which is held inside the developing roller 44*a* (image forming operation). In short, the position of the developer 4Ka in FIG. 10B corresponds to the "developing position" in the invention.

Meanwhile, in the developer 4Kd which is positioned at one position toward the downstream side relative to the developer 4Ka in the direction of rotations of the rotary developing unit 4, a telecommunication unit 49*d* disposed in the developer 4Kd comes opposed against a main telecommunication unit 109. This permits a wireless telecommunication access from the CPU 101 to the memory disposed in the developer 4Kd. Information regarding the status of use of this developer stored in the memory is updated in this condition (update operation). The position of the developer 4Kd in FIG. 10B is referred to the "access position" hereinlater.

As described above, the developing position and the access position are arranged so that when one developer mounted to the rotary developing unit 4 is positioned at the developing position, another developer is positioned at the access position. This makes it possible to update the memory while simultaneously executing the image forming operation, and therefore, shorten the processing time.

In this embodiment, each developer is determined for the life rank based on the residual toner quantity thereof and the cumulative time of rotation of the developing roller 44 thereof. The mode of image forming operation is varied according to the life ranks of the individual developers. This approach is taken to cope with the progressive changes of image quality encountered during the image formation using a developer which is deteriorated more as used longer. It is noted that the developers are classified into the ranks the same way as in the first embodiment described with reference to FIG. 3.

Figure 11:
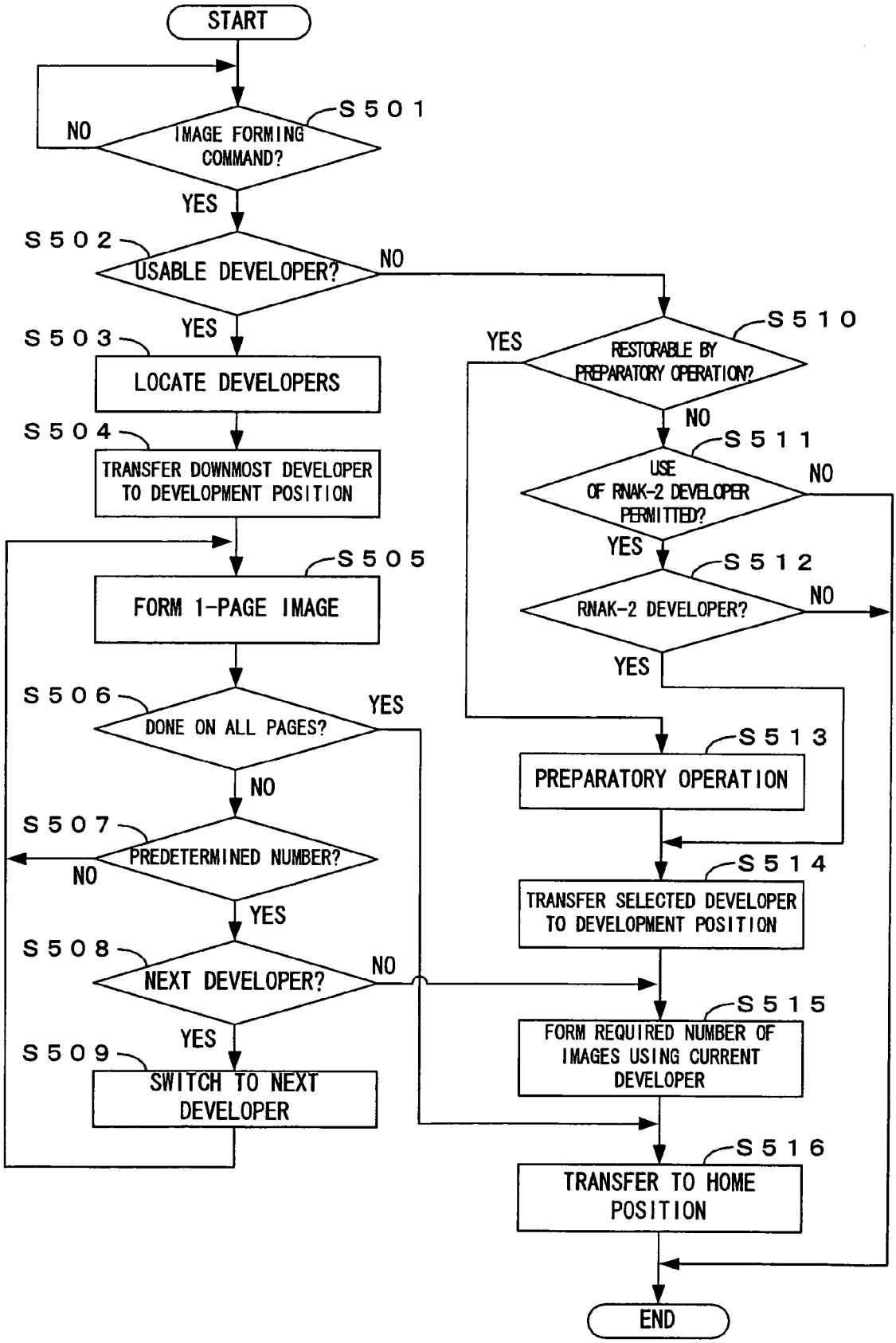
FIG. 11 is a flow chart showing the steps of the image forming operation of this embodiment.

FIG. 11 is a flow chart showing the steps of the image forming operation of this embodiment. When an image forming command is applied from the external apparatus, the apparatus starts the image forming operation (Step S501). In this image forming operation, determination is first made as to whether the development unit 4 is mounted with any usable developer or not (Step S502). The "usable" developer means here a developer classified as Rank 1 and unnecessary for the preparatory operation prior to the execution of the image forming operation. With such a developer mounted therein, the apparatus is capable of immediately forming images of a desired quality in correspondence to the image forming command.

In a case where there is at least one usable developer, the usable developer is determined for its location on the development unit 4 (Step S503). If two or more usable developers are located in adjoining relation, one of the developers that is located at the most-downstream-position with respect to the rotational direction D4 of the development unit 4 is transferred and positioned at the development position (Step S504). Subsequently, this developer is used to form a 1-page image (Step S505).

If this is what to be formed, or only 1-page image is to be formed (Step S506), the development unit 4 is returned to the home position to terminate the image forming operation (Step S516). Whereas, if there are some other images to be formed, the operation is continued to form such images. However, prior to the formation of such images, determination is made as to whether the number of images successively formed by the in-use developer reaches a predetermined number or not (Step S507). If the number of successively formed images does not reach the predetermined number (defined as eight in this embodiment), the operation flow returns to Step S505 to form the next image. If the predetermined number is reached, whether or not there is the next developer to be switched to use is determined (Step S508). If the next developer is available, the rotary development unit 4 is rotated 90 degrees to switch to the next developer and to position the next developer at the development position (Step S509). Whereas, if the next developer is not available, the changeover of developers is not performed and all the other images to be formed are formed using the in-use developer (Step S515).

Criteria for the determination in Step S508 are as follows. If a developer adjacent to and upstream from the in-use developer with respect to the rotational direction of the development unit 4 is usable, such a developer may be used as the next developer. A determination result in this case is "YES". In all the other cases than this, a determination result is "NO". For instance, if the in-use developer is the developer 4Ka whereas the developer 4Kb adjacent thereto and upstream therefrom is usable, the result of the determination in Step S508 is "YES". On the other hand, if the developer 4Kb adjacent to and upstream from the in-use developer 4Ka is not usable, the result of the determination in Step S508 is "NO" even though another usable developer is located at any other position.

If the usable developer is located at place adjacent to and upstream from the in-use developer, the substitutable developer may be transferred to the development position simply by rotating the development unit 4 by 90 degrees. Hence, the changeover of developers may be accomplished without decreasing the throughput of image formation. Since the next developer is classified as Rank 1 and is usable without being subjected to the preparatory operation, the apparatus may maintain the good quality of formed images.

The following effects may be obtained by making the changeover of developers during the operation of forming a series of images. If the apparatus continues to use one of the developers, the developer entails a progressive degradation of image quality because the toner around the developing roller is increased in the proportion of stale toner. In the meantime, the other developers are prone to the shutdown-induced banding because the respective developing rollers thereof are left standstill while carrying the toner on their surfaces. However, when the development unit 4 is rotated to switch from one developer to anther, the toner in the developers is agitated and homogenized so that the apparatus may maintain the good image quality. In addition, one of the developers is prevented from being used disproportionately long, whereby the individual developers are prevented from encountering the shutdown-induced banding.

On the other hand, if the developer adjacent to and upstream from the in-use developer is not usable, the image formation performed using such an unusable developer potentially involves a fear of significant variation of the image quality after the changeover of developers. Further, even though there is a usable developer at place other than that adjacent to and upstream from the in-use developer, the development unit 4 must be rotated 180 degrees or more to switch the in-use developer to the usable developer. Hence, the changeover takes so much time that the throughput is lowered. In these cases, therefore, the apparatus does not perform the changeover of developers, and continues to use the in-use developer.

The following operation is performed if it is determined in Step S502 that there is no usable developer. In a case where the developers mounted on the development unit 4 include no developer which is ready to use, an alternative developer is looked for. Specifically, determination is made as to whether or not there is a Rank-1 developer demanding the preparatory operation prior to the execution of the image forming operation (Step S510). If such a developer exists, the developer is subjected to the required preparatory operation (Step S513). Thereafter, the developer is transferred to the development position so as to form a required number of images (Steps S514 and S515).

In a case where there is no Rank-1 developer, a Rank-2 developer is looked for. In this embodiment, a user is able to previously set whether the image forming operation using the Rank-2 developer is allowed or inhibited. When the Rank-2 developer is used, there is a possibility that the quality of formed images is degraded. The degradation of image quality may be avoided by inhibiting the image formation in this state but the toner in the developer may not be used up effectively. On the other hand, if the image formation with some degree of degradation of image quality is allowed, it is possible to use up the toner effectively. Which of these options is the more important depends upon the user. If the apparatus is structured such that the user is able to choose between allowing the use of the Rank-2 developer and inhibiting the use thereof, the user may creatively use the apparatus according to the user's preference.

In a case where the user sets the apparatus to allow the use of the Rank-2 developer (Step S511), the image forming operation is performed using the Rank-2 developer if it is available (Steps S512 through S515). In this case, the user is thought to accept a certain degree of degradation of image quality and hence, it is not always necessary to perform the preparatory operation prior to the image forming operation. On the other hand, in cases where the user sets the apparatus to inhibit the use of the Rank-2 developer and where no Rank-2 developer is available, the operation flow comes to an end. That is, no image is formed in these cases. In such cases, it is desirable to somehow send an error message indicative of the fact that image formation is impossible to the user and the external apparatus which applied the image forming command to the image forming apparatus.

Figure 12:
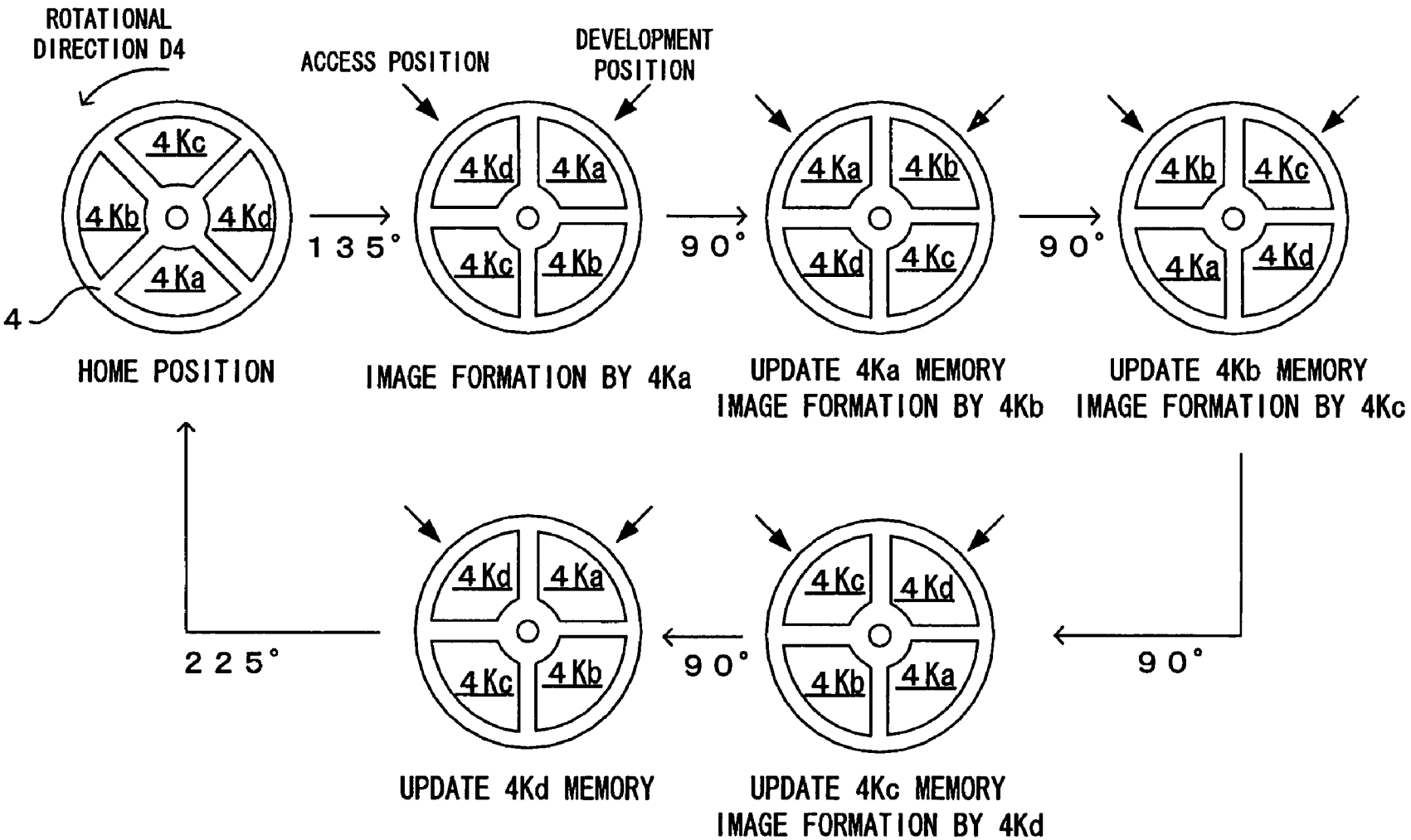
FIG. 12 is a diagram showing the transition of the development unit in a case where the four developers are usable.

FIG. 12 is a diagram showing the transition of the development unit in a case where the four developers are usable. In the case where all the four developers are usable, the notion of the "most-downstream-position" and the "most-upstream-position" with respect to the rotational direction of the development unit 4 is not existent, in principle, among the individual developers. In this case, the developer 4Ka, which is previously determined to be used first, is considered as a developer located at the most-downstream-position for convenience sake. That is, in the image forming operation in this case, the developer 4Ka is first transferred and positioned at the development position (Step S504 in FIG. 11). After the formation of the predetermined number of images by means of the developer 4Ka, the development unit 4 is rotated by 90 degrees, so that the next developer 4Kb which is adjacent to and upstream from the developer 4Ka is positioned anew at the development position (Step S509). At this time, the contents of information in the memory 91 are updated, the memory 91 disposed in the developer 4Ka transferred from the development position to the access position. Specifically, the latest residual toner quantity and the latest cumulative time of rotation of the developing roller are written in the memory 91. The latest residual toner quantity is given by subtracting a quantity of toner consumed for the image forming operation from the previous residual toner quantity stored in the memory 91. The latest cumulative time of rotation of the developing roller is given by adding a time of rotation of the developing roller related to the image forming operation to the previous cumulative time of rotation of the developing roller stored in the memory 91.

Subsequently, the same procedure is taken to make the changeover of developers at each formation of the predetermined number of images by means of one of the developers. At completion of the formation of a required number of images, the development unit 4 is returned to the home position (Steps S506 and S516). According to FIG. 12, the development unit 4 is returned to the home position after the image formation by means of the developer 4Kd and the update of the memory thereof. Depending upon the number of images to be formed, however, the apparatus may continue to form images by using the developer 4Ka again. Conversely, the apparatus may terminate the image forming operation before the developer 4Kd takes its turn.

Figure 13:
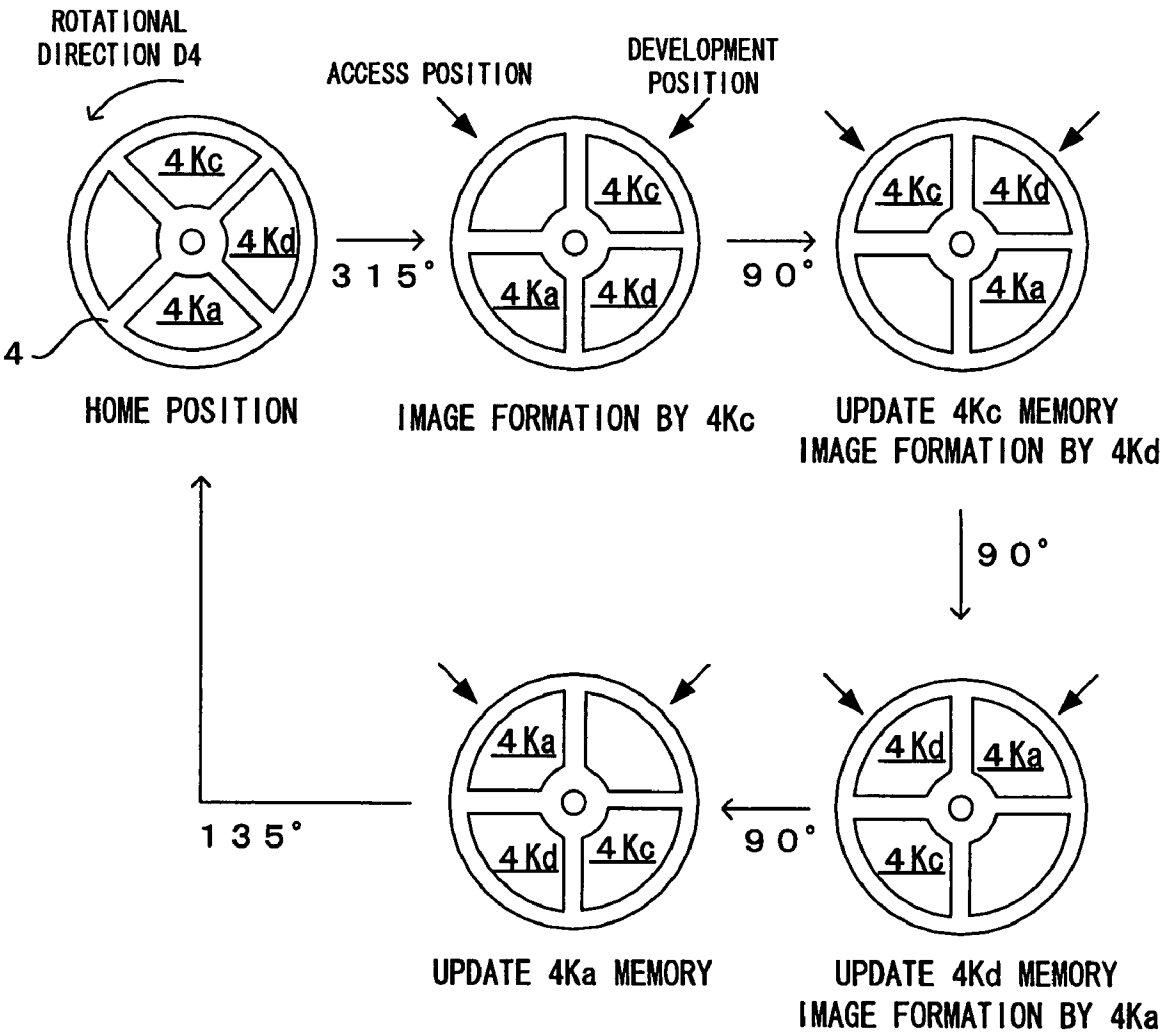
FIG. 13 is a diagram showing the transition of the development unit in a case where three developers are usable.

FIG. 13 is a diagram showing the transition of the development unit in a case where three developers are usable. In a case where three developers are usable in the development unit 4 which is capable of mounting four developers, these three developers are naturally located in adjoining relation. While the following description is made by way of an example of a case where three developers 4Ka, 4Kc and 4Kd are usable, the same holds for the other combinations of three developers.

In this case, the first to be used is the developer 4Ka according to the fundamental order. According to this embodiment, however, the developer 4Kc out of the three developers is used first, which is located at the most-downstream-position with respect to the rotational direction D4 of the development unit 4. That is, the development unit 4 positioned at the home position is rotated by 315 degrees in order to transfer the developer 4Kc to the development position (Step S504 in FIG. 11). After the image formation by means of the developer 4Kc, the development unit 4 is rotated in steps of 90 degrees for shifting each of the developers one place upstream each time (Step S509). When the number of images successively formed by means of the developer 4Ka at the most-upstream-position reaches the predetermined number (Step S507), there is no usable developer upstream from the developer 4Ka (Step S508). Therefore, the in-use developer 4Ka at this point in time is used for forming the remaining number of images (Step S515).

If these developers are used in the fundamental order, that is, in the same sequence as in the case where the four developers are used, the development unit 4 must be rotated by 180 degrees for switching from the developer 4Ka to the developer 4Kc. Such a rotational transfer of the developers takes so much time that the throughput of image formation is lowered. In this embodiment, on the other hand, the amount of rotation of the development unit 4 during the image formation is consistently 90 degrees. Thus, the embodiment can achieve a high throughput by minimizing the time taken to make changeover of developers. In addition, the embodiment offers an effective use of each of the developers in the usable state.

Figure 14:
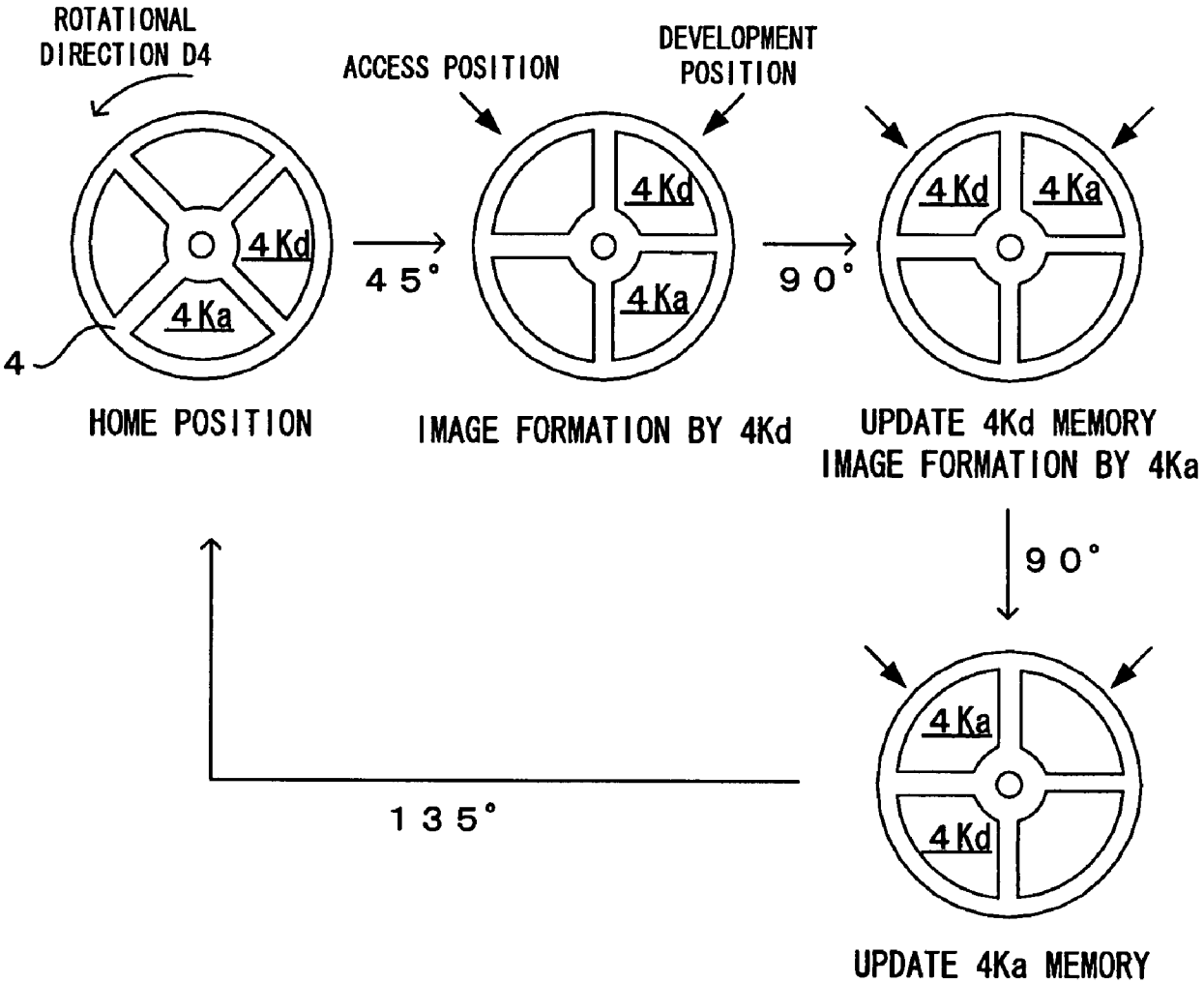
FIG. 14 is a diagram showing the transition of the development unit in a case where two adjoining developers are usable.

FIG. 14 is a diagram showing the transition of the development unit in a case where two adjoining developers are usable. It is assumed here that the developers 4Ka, 4Kd are usable. In this case, as well, the developer 4Ka is fundamentally the first to be used. According to this embodiment, however, the developer 4Kd on the downstream side is used first. In this case, therefore, the amount of rotation of the development unit 4 during the image formation is also consistently 90 degrees.

Figure 15:
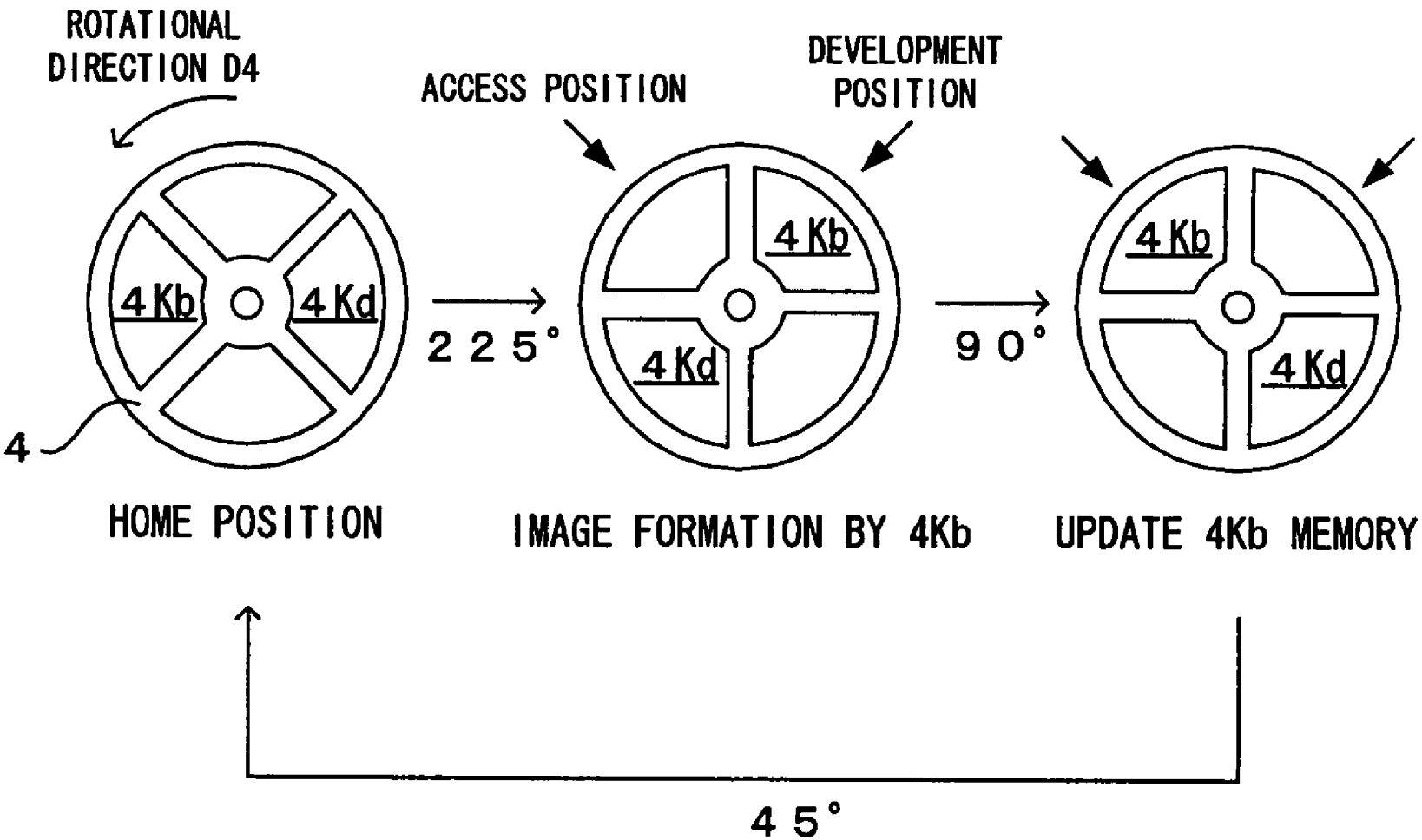
FIG. 15 is a diagram showing the transition of the development unit in a case where two developers located in symmetrical relation are usable.

FIG. 15 is a diagram showing the transition of the development unit in a case where two developers located in symmetrical relation are usable. It is assumed here that the developers 4Kb and 4Kd are usable. In this case, there is no usable developer at place adjacent to and upstream form either of the developers. In this case, therefore, the apparatus does not perform the changeover of developers and uses the first selected one of the developers for forming a required number of images. Although either of the developers may be selected as the first to be used, it is desirable to select the one that was not used in the previous image forming operation. This is because this selection permits each of the developers to be used more effectively. By using the developer not used in the previous image forming operation, as described above, the two developers are alternately used in terms of results. Thus is obviated the occurrence of density irregularities (shutdown-induced banding) resulting from that one of the developers is left standstill for long hours. Hence, the apparatus is prevented from falling into the state requiring the preparatory operation. Accordingly, the apparatus may be maintained in the state to be able to form images of good quality over an even longer period of time. As a result, the embodiment ensures that the images corresponding to the image forming command are formed without delay and in good quality.

As described above, according to this embodiment, when the development unit 4 is mounted with two or three developers in adjoining relation, one of the developers that is located at the most-downstream-position with respect to the rotational direction of the development unit 4 is used first to execute the image forming operation. Then, a required number of images are formed while switching the in-use developer to the adjoining developer on the upstream side each time a predetermined number of images are formed. Accordingly, the embodiment can ensure that a small number of images or a large number of images are formed in good quality and in a consistent manner. Furthermore, the embodiment provides the effective use of each of the developers ranging from the most-downstream-position to the most-upstream-position.

Further, since the changeover of developers during the image formation is made between the adjoining developers, the changeover from one developer to another may be accomplished in such a short time that the images may be formed with high throughput. In addition, the shutdown-induced banding may be obviated by preventing one of the developers from being used disproportionately long. Thus, the embodiment may reduce the frequency of the execution of the preparatory operation while providing the consistent image quality.

As described above, this embodiment corresponds to a case of N=4, M=2 or 3 in a third aspect of the invention. The rotary development unit 4 and the engine controller 10 of this embodiment function as a "rotary development section" and a "controller" of the third aspect of the invention, respectively.

Third to Fifth Embodiments

Next, image forming apparatuses according to third to fifth embodiments of the invention will be described. Although the image forming apparatuses according to the third to fifth embodiments hereof have the same construction and electrical structure as those of the first embodiment shown in FIGS. 1 and 2, the developer to be used and the mode of switching the developers vary in each of the embodiments. The individual embodiments will hereinbelow be described in turn.

It is noted that stop positions of the rotary development unit in the third to fifth embodiments are the same as those of the second embodiment described with reference to FIGS. 10A and 10B.

Further, in the third to fifth embodiments, the same as in the second embodiment, the individual developers are used in turn along the rotational direction D4 of the rotary development unit 4. As required, an in-use developer is switched to a developer located one place upstream therefrom and the developer so switched is used. Hence, the changeover of developers during the image forming operation is accomplished simply by rotating the rotary development unit 4 by 90 degrees in the rotational direction thereof. However, which of the developers is to be used first is previously determined.

In this embodiment, the developer 4Ka is the first to be used, but the invention is not limited to this.

Further, in the third to fifth embodiments, the same as in the second embodiment, each developer is determined for the life rank based on the residual toner quantity thereof and the cumulative time of rotation of the developing roller 44 thereof. The mode of image forming operation is varied according to the life ranks of the individual developers. This approach is taken to cope with the progressive changes of image quality encountered during the image formation using a developer which is deteriorated more as used longer. It is noted that the developers are classified into the ranks the same way as in the first embodiment described with reference to FIG. 3.

Third Embodiment

In an image forming operation according to the third embodiment, the image forming apparatus retrieves the number of images to be formed from an image forming command applied from the external apparatus, and varies the sequence of switching developers according to the number of images to be formed.

Figure 16:
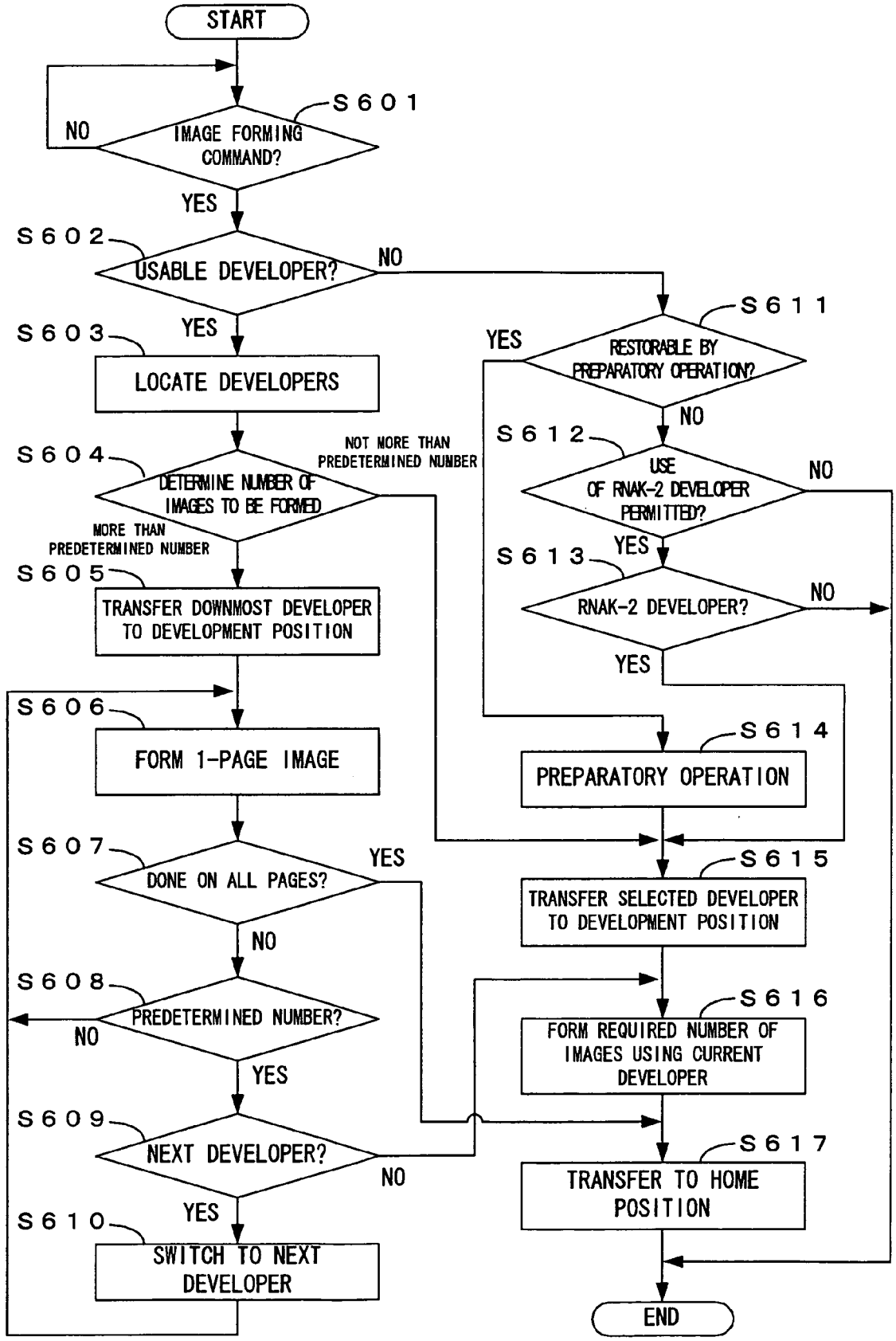
FIG. 16 is a flow chart showing the steps of the image forming operation of the third embodiment.

FIG. 16 is a flow chart showing the steps of the image forming operation of the third embodiment. When an image forming command is applied from the external apparatus, the apparatus starts the image forming operation (Step S601). In this image forming operation, determination is first made as to whether the development unit 4 is mounted with any usable developer or not (Step S602). The "usable" developer means here a developer classified as Rank 1 and unnecessary for the preparatory operation prior to the execution of the image forming operation. With such a developer mounted therein, the apparatus is capable of immediately forming images of a desired quality in correspondence to the image forming command.

In a case where there is at least one usable developer, the usable developer is determined for its location on the development unit 4 (Step S603). Next, determination is made as to whether the number of images to be formed, which is specified by the image forming command, exceeds a predetermined number (eight, for example) or not (Step S604). The subsequent operations vary according to the determination result.

First, description is made on a case where the number of images to be formed exceeds the predetermined number. If the apparatus keeps using a single developer to form a large number of images, the formed images are progressively degraded in quality because of a decreased quantity of residual toner in the developer or an uneven toner distribution inside the developer. In addition, the length of time in which the other developers are left unused is extended, so that these developers are more likely to sustain the shutdown-induced banding. In the formation of a large number of images, therefore, it is desirable to use plural developers while switching to the utmost extent. Hence, the embodiment is arranged such that in the case where the number of images to be formed exceeds the predetermined number, the changeover of developers is performed in the course of forming these images.

Specifically, in a case where two or more usable developers are located in adjoining relation, one of the developers that is located at the most-downstream-position with respect to the rotational direction D4 of the development unit 4 is transferred and positioned at the aforesaid development position (Step S605). Subsequently, the developer so positioned is used to form a 1-page image (Step S606). It is noted that in a case where only one usable developer is mounted, the developer is used in the image formation. In a case where plural usable developers are not located in adjoining relation, one of the developers that has the longest shutdown time is used in the image formation. This is for the purpose of preventing the shutdown-induced banding.

If the formation of all the images to be formed is completed (Step S607), the information in the respective memories of the developers is updated and then, the development unit 4 is returned to the home position to terminate the image forming operation (Step S617). Since only one of the images exceeding the predetermined number is formed at this point in time, the image forming operation is continued to form the other images. Prior to the formation of the other images, determination is made as to whether the number of images successively formed using the current developer reaches the predetermined number or not (Step S608). If the predetermined number is not reached, the operation flow returns to Step S606 to form the next image. If the predetermined number is reached, determination is made as to whether the next developer to be switched to use is available or not (Step S609). If the next developer is available, the current developer is switched to the next one by rotating the rotary development unit 4 by 90 degrees, so that the next developer is positioned at the development position (Step S610). If the next developer is not available, the changeover of developers is not performed and the in-use developer is used for forming the other images to be formed (Step S616).

Criteria for the determination in Step S609 are as follows. If a developer adjacent to and upstream from an in-use developer with respect to the rotational direction of the development unit 4 is usable, the adjoining developer may be used as the next one. A determination result in this case is "YES". In all the other cases other than this, a determination result is "NO". For instance, if the in-use developer is the developer 4Ka whereas the developer 4Kb adjacent thereto and upstream therefrom is usable, the result of determination in Step S609 is "YES". On the other hand, if the developer 4Kb adjacent to and upstream from the in-use developer 4Ka is not usable, the result of determination in Step S609 is "NO" even though there is another usable developer at any other position.

If there is a usable developer at place adjacent to and upstream from the in-use developer, the substitutable developer may be transferred to the development position simply by rotating the development unit 4 by 90 degrees. Hence, the changeover of developers may be accomplished without lowering the throughput of image formation. Since the next developer is classified as Rank 1 and is usable without being subjected to the preparatory operation, the apparatus may maintain the good quality of formed images.

The following effects may be obtained by making the changeover of developers during the operation of forming a series of images. If the apparatus continues to use one of the developers, the developer entails a progressive degradation of image quality because the toner around the developing roller is increased in the proportion of stale toner. In the meantime, the other developers are prone to the shutdown-induced banding because the respective developing rollers thereof are left standstill while carrying the toner on their surfaces. However, when the development unit 4 is rotated to switch from one developer to another, the toner in the developers is agitated and homogenized so that the apparatus may maintain the good image quality. In addition, one of the developers is prevented from being used disproportionately long, whereby the individual developers are prevented from encountering the shutdown-induced banding.

On the other hand, in a case where the developer adjacent to and upstream from the in-use developer is not usable, the image formation performed using such an unusable developer potentially involves a fear of significant variation of the image quality after the changeover of developers. Further, even though there is a usable developer at place other than that adjacent to and upstream from the in-use developer, the development unit 4 must be rotated by 180 degrees or more to switch the in-use developer to the usable developer. Hence, the changeover takes so much time that the throughput may be lowered. In these cases, therefore, the apparatus does not make the changeover of developers, and continues to use the in-use developer.

Next, description is made on a case where it is determined in Step S604 that the number of images to be formed, which is specified by the image forming command, is not more than the predetermined number. The formation of a small number of images scarcely encounters the degradation of image quality, which results from the continued use of the same developer. Furthermore, these images may be formed in a relatively short time and hence, the influence on the other unused developers is insignificant. In this case, therefore, the apparatus does not perform the changeover of developers and exclusively uses the first selected one of the developers. In a case where plural developers are usable, however, in order to prevent one of the developers from being used disproportionately long, a developer that has the longest shutdown time from the previous use thereof is selected, irrespective of the locations of the usable developers.

The developer thus selected is transferred to the development position (Step S615) and is used to form the required number of images (Step S616). After completion of the image formation, the development unit 4 is transferred to the home position to terminate the image forming operation.

The following operation is performed in a case where it is determined in Step S602 that there is no usable developer. In a case where the developers mounted on the development unit 4 include no developer which is ready to use, an alternative developer is looked for. Specifically, determination is made as to whether or not there is a Rank-1 developer demanding the preparatory operation prior to the image forming operation (Step S611). If such a developer is available, the developer is subjected to the required preparatory operation (Step S614). Thereafter, the developer is transferred to the development position so as to form the required number of images (Steps S615 and S616) In a case where there is no Rank-1 developer, a Rank-2 developer is looked for. In this embodiment, a user is able to previously set whether the image forming operation using the Rank-2 developer is allowed or inhibited. When the Rank-2 developer is used, there is a possibility that the quality of formed images is degraded. The degradation of image quality may be avoided by inhibiting the image formation in this state but the toner in the developer may not be used up effectively. On the other hand, if the image formation with some degree of degradation of image quality is allowed, it is possible to use up the toner effectively. Which of these options is the more important depends upon the user. If the apparatus is structured such that the user is able to choose between allowing the use of the Rank-2 developer and inhibiting the use thereof, the user may creatively use the apparatus according to the user's preference.

In a case where the user sets the apparatus to allow the use of the Rank-2 developer (Step S612), the image forming operation is performed using the Rank-2 developer if it is available (Steps S613 to S616). In this case, the user is thought to accept a certain degree of degradation of image quality and hence, it is not always necessary to perform the preparatory operation prior to the image forming operation. On the other hand, in cases where the user sets the apparatus to inhibit the use of the Rank-2 developer and where no Rank-2 developer is available, the operation flow comes to an end. That is, no image is formed in these cases. In such cases, it is desirable to somehow send an error message indicative of the fact that image formation is impossible to the user and the external apparatus which applied the image forming command to the image forming apparatus.

Figure 17:
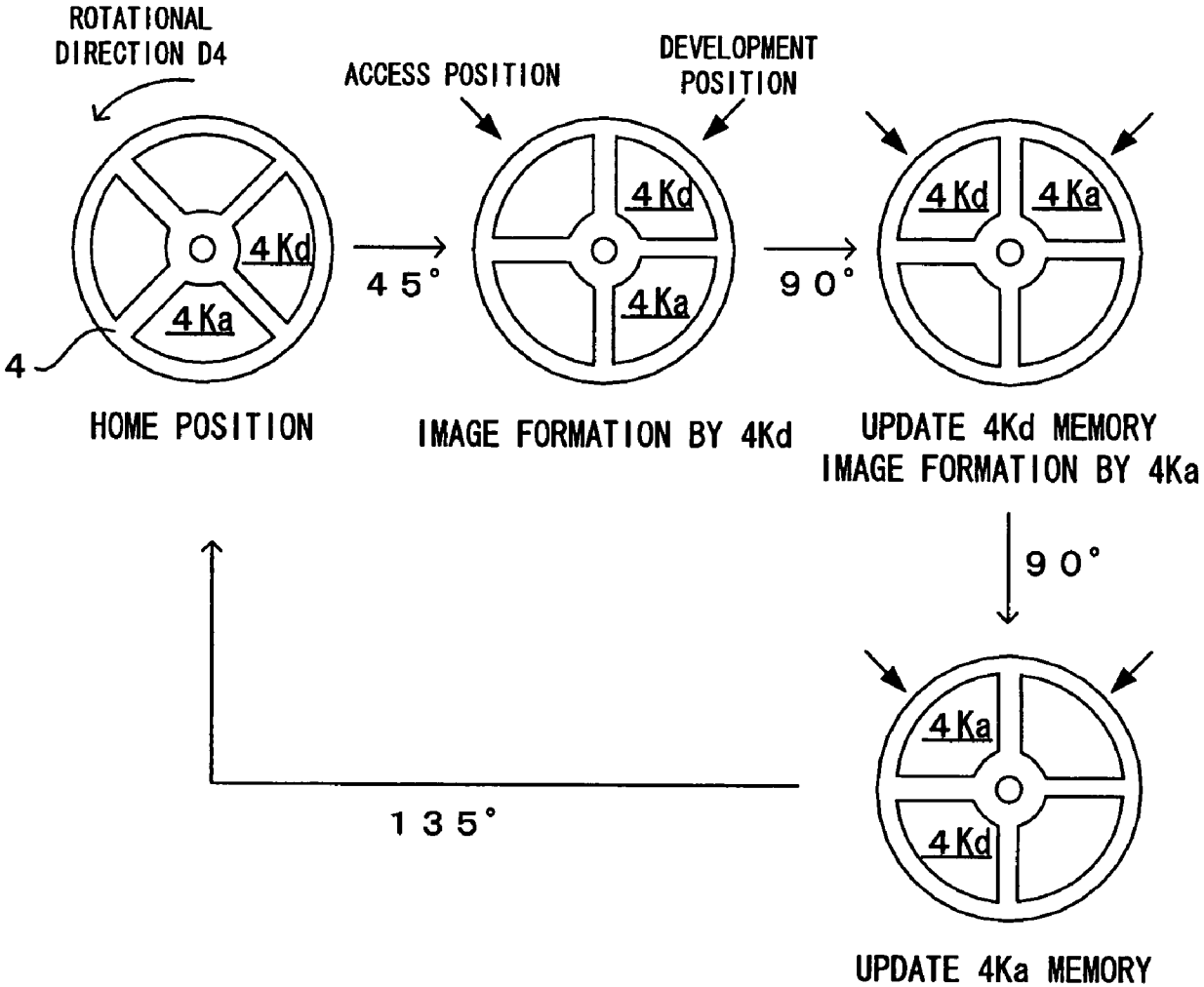
FIG. 17 is a diagram showing the transition of the development unit in a case where two adjoining developers are usable.

FIG. 17 is a diagram showing the transition of the development unit in a case where two adjoining developers are usable. It is assumed here that the developers 4Ka, 4Kd are usable. In a case where all the developers are usable, the developer 4Ka should be used first. In this example, however, the developer 4Kd on the downstream side, out of the two usable developers, is used first. After the formation of the predetermined number of images by means of the developer 4Kd, the development unit 4 is rotated 90 degrees. This brings the developer 4Ka on the upstream side to the development position, whereas the developer 4Kd is transferred to the access position. In this state, the contents of information in the memory 94 disposed in the developer 4Kd are updated, while images are formed by means of the developer 4Ka. Specifically, the latest residual toner quantity and the latest cumulative time of rotation of the developing roller are written in the memory 94. The latest residual toner quantity is given by subtracting a quantity of toner consumed for the image forming operation from the previous residual toner quantity stored in the memory 94. The latest cumulative time of rotation of the developing roller is given by adding a time of rotation of the developing roller related to the image forming operation to the previous cumulative time of rotation of the developing roller stored in the memory 94. When all the remainder images are formed by means of the developer 4Ka, the development unit 4 is rotated further 90 degrees. After the contents of information in the memory 91 disposed in the developer 4Ka are updated, the development unit 4 is returned to the home position.

Figure 18:
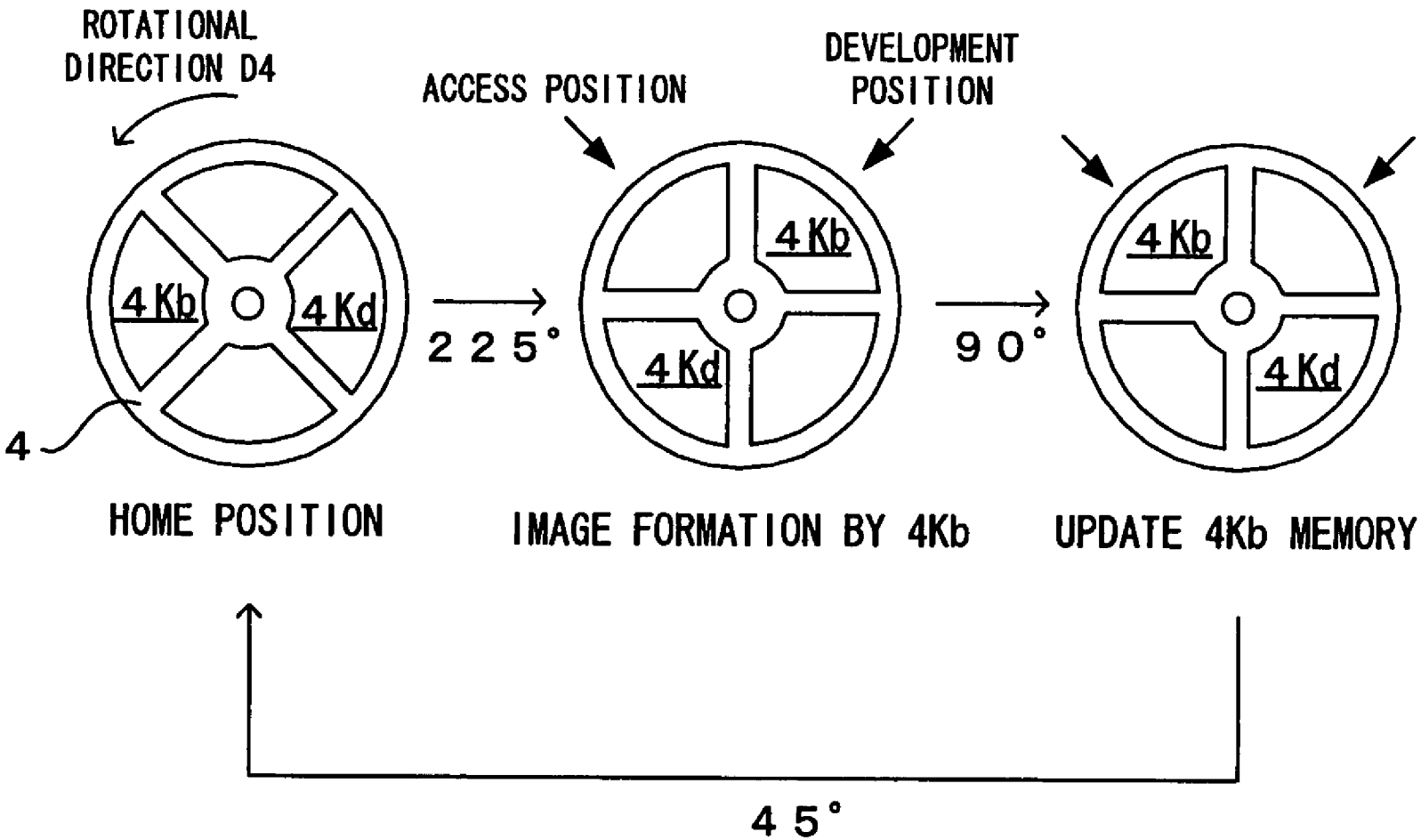
FIG. 18 is a diagram showing the transition of the development unit in a case where two developers located in symmetrical relation are usable.

FIG. 18 is a diagram showing the transition of the development unit in a case where two developers located in symmetrical relation are usable. It is assumed here that the developers 4Kb and 4Kd are usable. In this case, there is no usable developer at place adjacent to and upstream form either of the developers. In this case, therefore, the apparatus does not perform the changeover of developers and uses the first selected one of the developers for forming a required number of images. As the first to be used, the developer that was not used in the previous image forming operation is selected. The developer 4Kb is selected to be used in the example shown in FIG. 18.

When a new image forming command is applied afterwards, the developer 4Kd is selected to be used which was not used in the previous image forming operation. By using the developer not used in the previous image forming operation, as described above, the two developers are alternately used in terms of results. Thus is obviated the occurrence of density irregularities (shutdown-induced banding) resulting from that one of the developers is left standstill for long hours. Hence, the apparatus is prevented from falling into the state requiring the preparatory operation. Accordingly, the apparatus may be maintained in the state to be able to form images of good quality over an even longer period of time. As a result, the embodiment ensures that the images corresponding to the image forming command are formed without delay and in good quality.

Further, in a case where the number of images to be formed is less than the predetermined number, one of the usable developers that has the longest shutdown time is used irrespective of the number or locations of the usable developers and the in-use developer is not switched during the formation of the images. In this case, as well, the development unit 4 is also shifted as shown in FIG. 18.

Further, in a case where three developers are usable in the development unit 4, these three developers are naturally located in adjoining relation, since the development unit 4 is capable of mounting four developers. Therefore, in this case, if the number of images to be formed exceeds the predetermined number, the three developers are used in turn while switched from the downstream one to the upstream one. If the number of images to be formed is not more than the predetermined number, one of the three developers that has the longest shutdown time is used.

As described above, according to the embodiment, the developers are used while switching if the number of images to be formed exceeds the predetermined number. If the number of images to be formed is not more than the predetermined number, on the other hand, the apparatus does not perform the changeover of developers and selectively uses one of the developers that has the longest shutdown time. Therefore, the apparatus is capable of forming images of good and consistent quality while preventing one of the developers from being used disproportionately long and using the individual developers effectively. In addition, the changeover of developers may quickly be accomplished because the in-use developer is switched to the developer adjacent thereto and upstream therefrom. Thus, the decrease of throughput of image formation may be prevented.

Fourth Embodiment

An image forming apparatus according to the fourth embodiment of the invention is arranged to move the development unit 4 in different ways depending upon whether the image forming command applied from the external apparatus dictates the image formation on the both sides of the sheet S or the image formation only on one side of the sheet S. In a case where plural images are formed on different sheets, respectively, the individual sheets may be fed into the secondary transfer region TR2 one after another and hence, the images may be successively formed at minor time intervals to separate the individual images. Furthermore, this approach is effective to increase the throughput of image formation. In a case where images are formed on the both sides of the sheet, however, the sheet must be turned over after the image formation on one side thereof in the secondary transfer region TR2 and then, be delivered again to the secondary transfer region TR2. Therefore, a longer time interval than that for the image formation only on one side of the sheet must be provided between two images to be transferred to the both sides of one sheet.

Figure 19A:
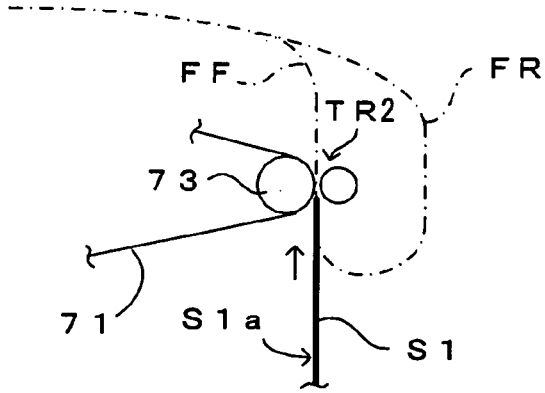
FIGS. 19A to 19D are diagrams schematically showing how the sheet is transported.
Figure 19B:
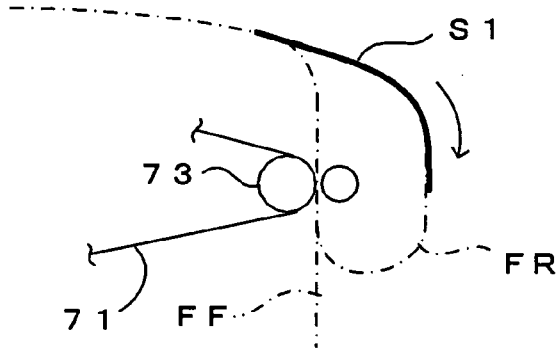
Figure 19C:
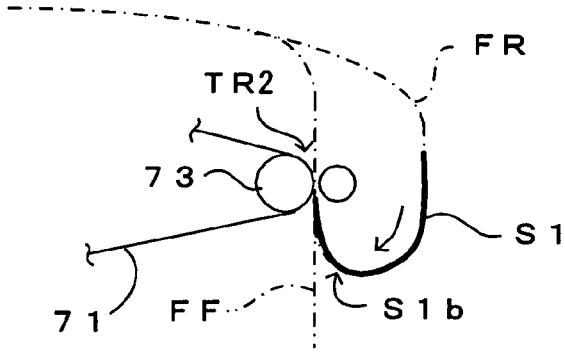

FIGS. 19A to 19D are diagrams schematically showing how the sheet is transported. In the case of the image formation on the both sides of one sheet S1, one side (one principal surface) S1*a* of the sheet S1 is first fed into the secondary transfer region TR2 along the transportation path FF, as shown in FIG. 19A. The sheet S1 which passed through the secondary transfer region TR2 is transported along the reversal transportation path FR (FIG. 19B). Subsequently, the other side (the other principal surface) S1*b* of the sheet S1 is fed into the secondary transfer region TR2 where an image is transferred from the intermediate transfer belt 71 to the sheet (FIG. 19C).

Figure 19D:
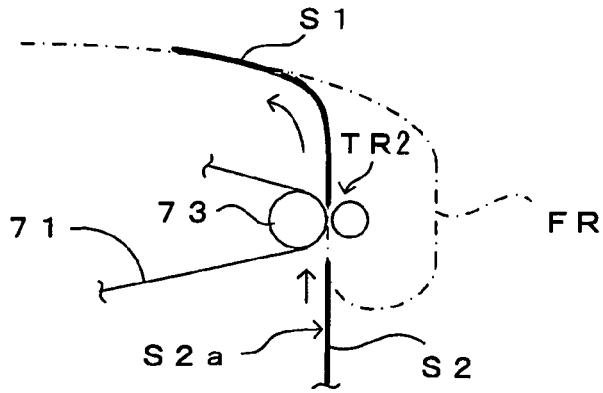

Thus a certain free time is produced between the passage of the one side S1*a* of the sheet S1 through the secondary transfer region TR2 and the delivery of the other side S1*b* to the secondary transfer region TR2. The free time corresponds to a length of time required for turning over the sheet S1 which depends upon the transportation speed of the sheet S1 and the length of the reversal transportation path FR. Because of the construction of the apparatus, it is not easy to reduce the length of the free time. On the contrary, let us consider a case where the image transfer to the sheet S1 is followed by image transfer to a sheet S2. After the passage of the sheet S1 through the secondary transfer region TR2, the succeeding sheet S2 may be fed into the secondary transfer region TR2 at a shorter time interval than the aforesaid free time, as shown in FIG. 19D.

Specifically, in the image forming apparatus structured as described above, the free time in the case of feeding the both sides of one sheet into the secondary transfer region TR2 is longer than the free time in the case of feeding two sheets successively. Hence, the embodiment takes advantage of the free time to make the changeover of developers, thereby efficiently operating the apparatus without lowering the throughput of image formation. That is, the embodiment is adapted to execute operation modes which include a one-side print mode, in which the image is formed only on one side of the sheet, and a double-side print mode, in which the images are formed on the both sides of the sheet. The sequence of shifting the development unit 4 varies depending upon the operation modes.

Figure 20:
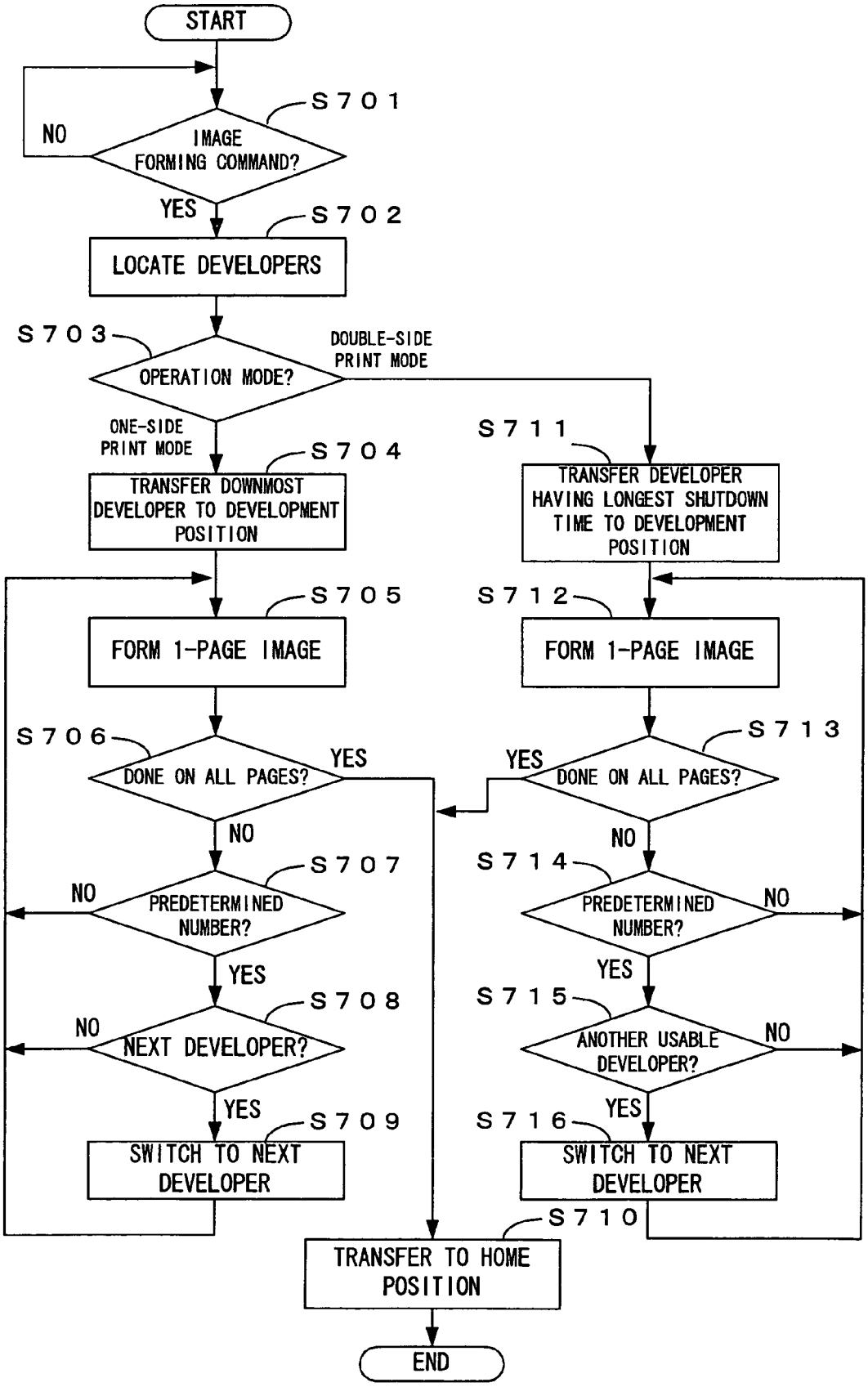
FIG. 20 is a flow chart showing the steps of the image forming operation according to the fourth embodiment.

FIG. 20 is a flow chart showing the steps of the image forming operation according to the fourth embodiment. In this embodiment, whether the operation mode to be executed is the one-side print mode or the double-side print mode is determined based on the image forming command applied from the external apparatus (Step S703). The subsequent operations vary depending upon the determination results. In the case of the one-side print mode (Steps S701 to S710), the operations except for the determination of the operation mode (Step S703) are basically the same as those of the third embodiment (Steps S601 to S610 in FIG. 16). While FIG. 20 omits the illustration of the operations performed when there is no usable developer (Steps S602 and S611 to S616 in FIG. 16), the same process as that of the third embodiment may be performed.

In the case of the double-side print mode, one developer having the longest shutdown time from the previous use thereof is selected from the usable developers and is transferred to the development position (Step S711). The developer is used to form a 1-page image just as in the third embodiment (Step S712). If this is what to be formed, the operation is terminated (Step S713). The apparatus continues to use the same developer to form images until the number of images successively formed by means of the in-use developer reaches the predetermined number (Step S714).

When the number of images successively formed by means of the in-use developer reaches the predetermined number, the apparatus performs a different operation from that of the third embodiment or that of the one-side print mode described above. Specifically, in the double-side print mode, if there is a usable developer which may be located at any of the positions on the development unit 4 and which is not limited to one adjacent to and upstream from the in-use developer, the in-use developer is switched to the usable developer (Steps S715 and S716). In the double-side print mode, as described above, a relatively great time interval is provided between the formations of two images to be transferred to the both sides of one sheet. This time interval allows the development unit 4 to be rotated by more than 90 degrees and hence, the throughput of image formation is not lowered by switching the in-use developer to a developer at any other position than that adjacent to and upstream from the in-use developer. Furthermore, this approach permits the apparatus to use the individual developers more efficiently. In this case, the changeover of developers may desirably be made at such a time that the number of successively formed images reaches "the predetermined number" when an image to be transferred to the first side of one sheet is formed. To meet this purpose, "the predetermined number" may alternate between an odd number and an even number at each changeover of developers, for example.

Figure 21:
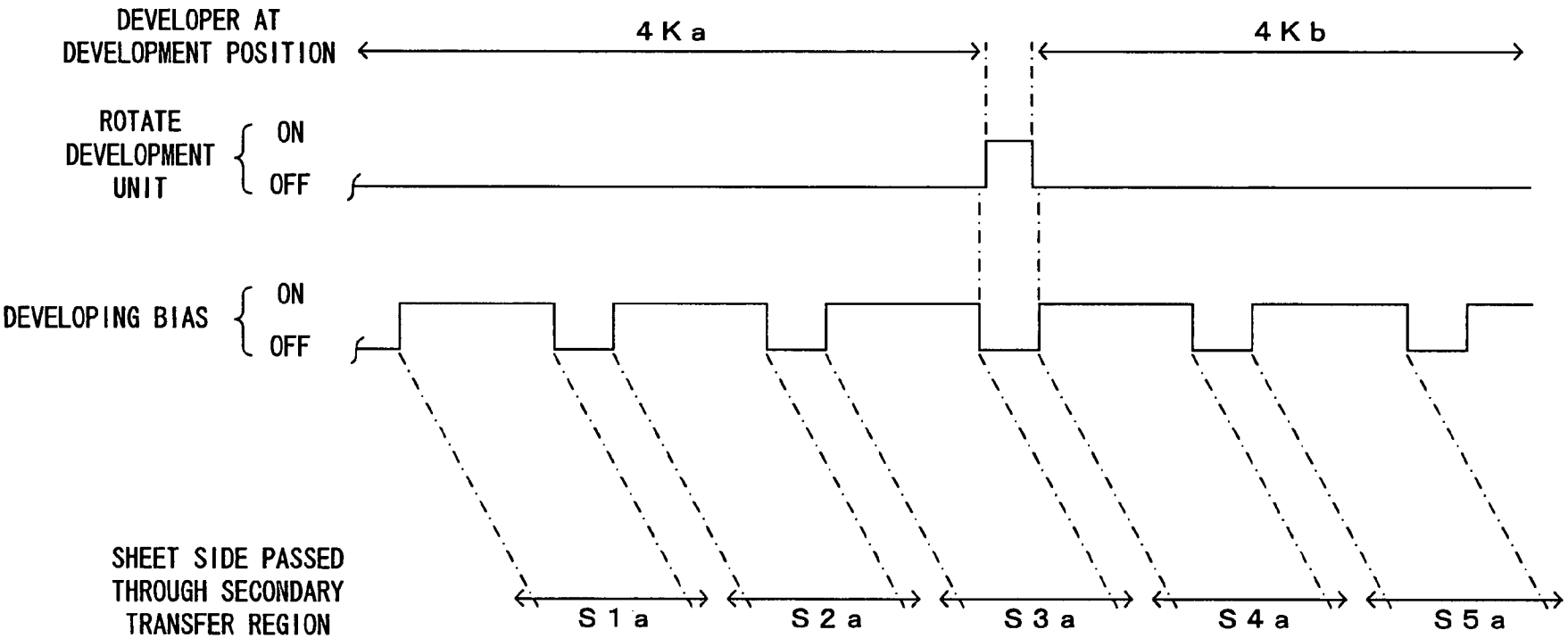
FIG. 21 is a timing chart showing the timings of operations of the individual parts in the one-side print mode.
Figure 22:
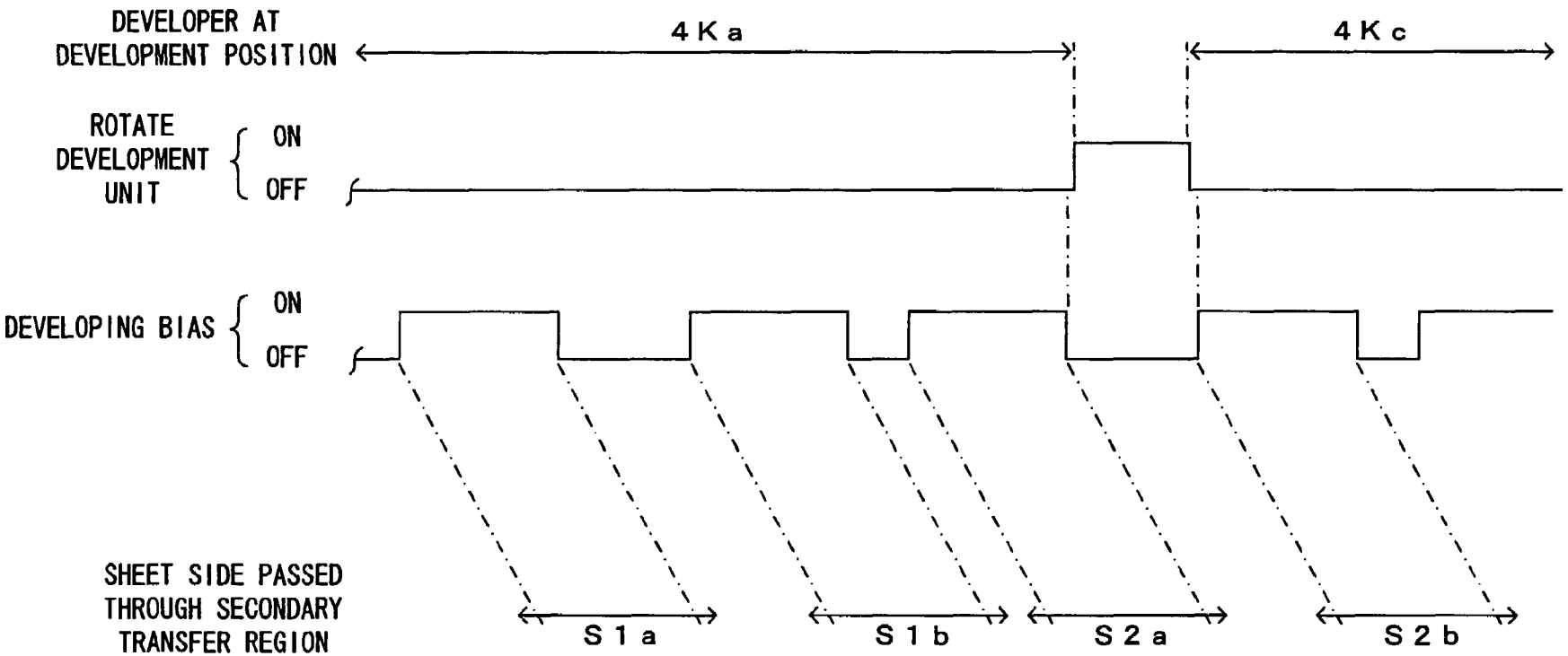
FIG. 22 is a timing chart showing the timings of operations of the individual parts in the double-side print mode.

FIG. 21 is a timing chart showing the timings of operations of the individual parts in the one-side print mode. FIG. 22 is a timing chart showing the timings of operations of the individual parts in the double-side print mode. It is assumed here that the developer 4Ka is used first. In these figures, the application of the developing bias to the developer indicates that the image forming operation using the developer is under way. In the one-side print mode, as shown in FIG. 21, respective one sides S1*a*, S2*a*, . . . of different sheets are passed through the secondary transfer region TR2 at regular intervals. The interval may have such a length as to prevent the sheets from being mutually overlapped and hence, is relatively short. Accordingly, a time period during which the developer is not used is also short. Hence, the changeover of developers must be accomplished quickly.

In the double-side print mode, on the other hand, a relatively long interval is provided between the time the one side S1*a*, S2*a* of each sheet is passed through the secondary transfer region TR2 and the time the other side S1*b*, S2*b* of each sheet reaches the secondary transfer sheet TR2 respectively, as shown in FIG. 22. The development unit 4 may be rotated during this interval, thereby switching the in-use developer to another developer located at any other place than that adjacent thereto and upstream therefrom.

In this manner, the embodiment permits the in-use developer to be switched exclusively to the developer adjacent thereto and upstream therefrom when the apparatus executes the one-side print mode in which the relatively short interval is provided between the image formations. When the apparatus executes the double-side print mode, on the other hand, the embodiment permits the in-use developer to be switched also to a developer located at any other place than that adjacent to and upstream from the in-use developer, taking advantage of the relatively long interval between the formations of the two images to be transferred to the respective sides of one sheet. Such an approach permits the apparatus to use the individual developers efficiently according to the operation mode thereof, without lowering the throughput.

In addition, in a case where the changeover of developers is performed in the double-side print mode of the embodiment and where a usable developer is located adjacent to and upstream from the in-use developer, the in-use developer may naturally be switched to the adjacent developer. Further, in the case where the usable developer is located adjacent to and upstream from the in-use developer, the embodiment may also permit the in-use developer to be switched to the adjacent developer during the shorter interval between the formation of an image to be transferred to the latter side of one sheet and the formation of an image to be transferred to the first side of the next sheet.

Fifth Embodiment

An image forming apparatus according to the fifth embodiment of the invention is arranged to move the development unit 4 in different ways depending upon the sheet size specified by the image forming command applied from the external apparatus. The image forming apparatus of this type is required to handle sheets of various sizes. In a case where images are formed in correspondence to sheets of different sizes, it is idealistic in terms of throughput to apply the image forming operation sequences varying from one sheet size to another. However, the application of the image forming operation sequences varying from one sheet size to another involves complicated controls of the individual parts of the apparatus. In cases, the implementation of such complicated controls is difficult because of the construction of the apparatus. For instance, in a case where a sheet length with respect to the sheet transportation direction is not constant, in particular, the apparatus must be adapted to vary the rotational speed of the intermediate transfer belt 71 on a per-sheet-size basis in order to match the cycle period of the operation sequence with the sheet size. Hence, it is more practical that one or more types of operation sequences corresponding to standard sheet sizes may be previously prepared such that in the case of a sheet of any other size, the operation sequence corresponding to a sheet size closest to the sheet size of interest may be applied to the operation.

In this embodiment, the operation sequence is designed on a basis of A4 size of JIS (Japanese Industrial Standards) as the standard sheet size. The same operation sequence may be used to handle a B5-size sheet slightly shorter than the A4-size sheet and a legal-size sheet slightly longer than the A4-size sheet. As to the loading with sheets of a different size to the sheet cassette 8, the user may load such sheets as needed. Otherwise, an additional manual paper feed tray may be provided or a plural number of cassettes may be provided such that sheets of different sizes may be previously loaded in the respective cassettes.

Figure 23:
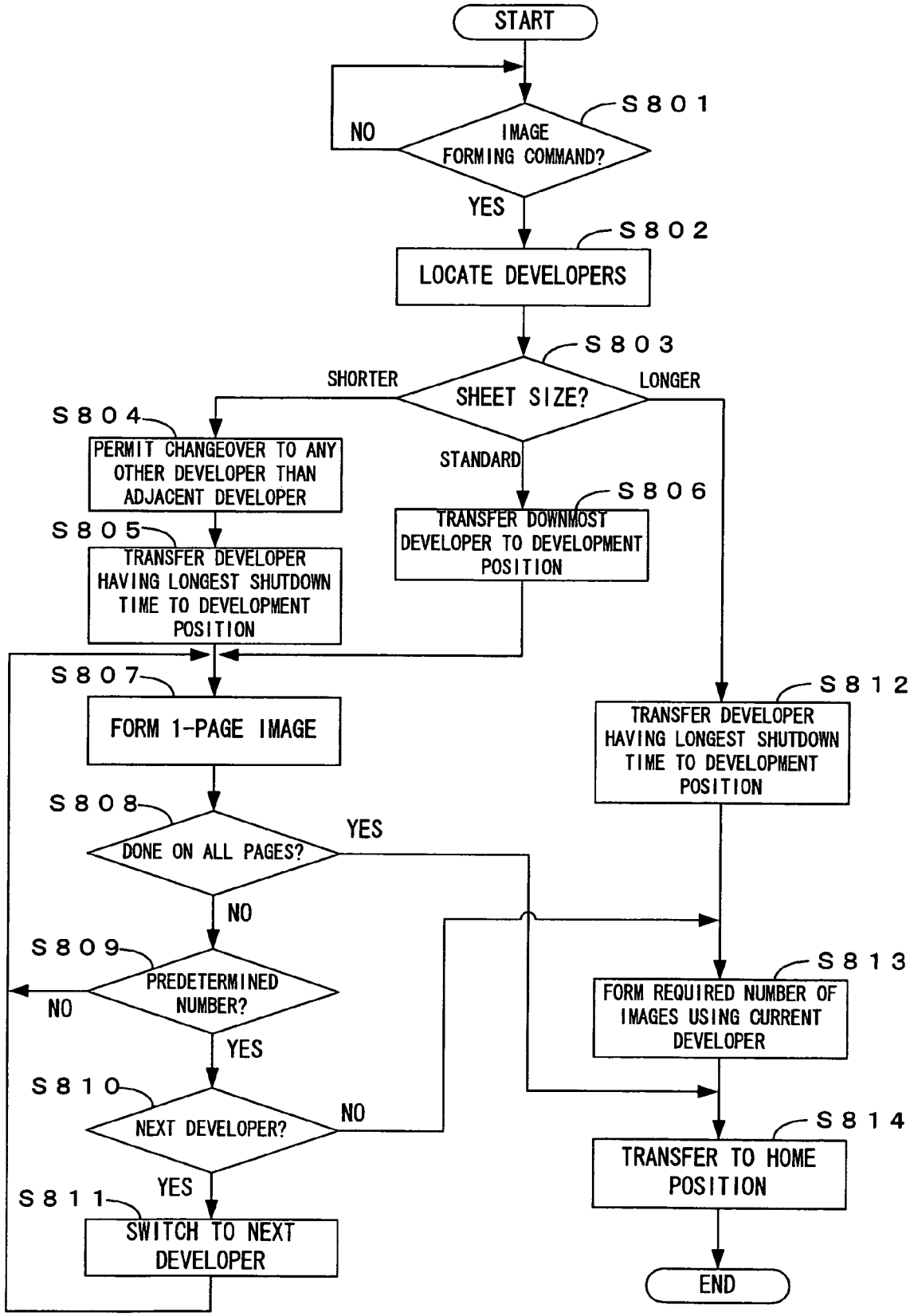
FIG. 23 is a flow chart showing the steps of the image forming operation according to the fifth embodiment.
Figure 24:
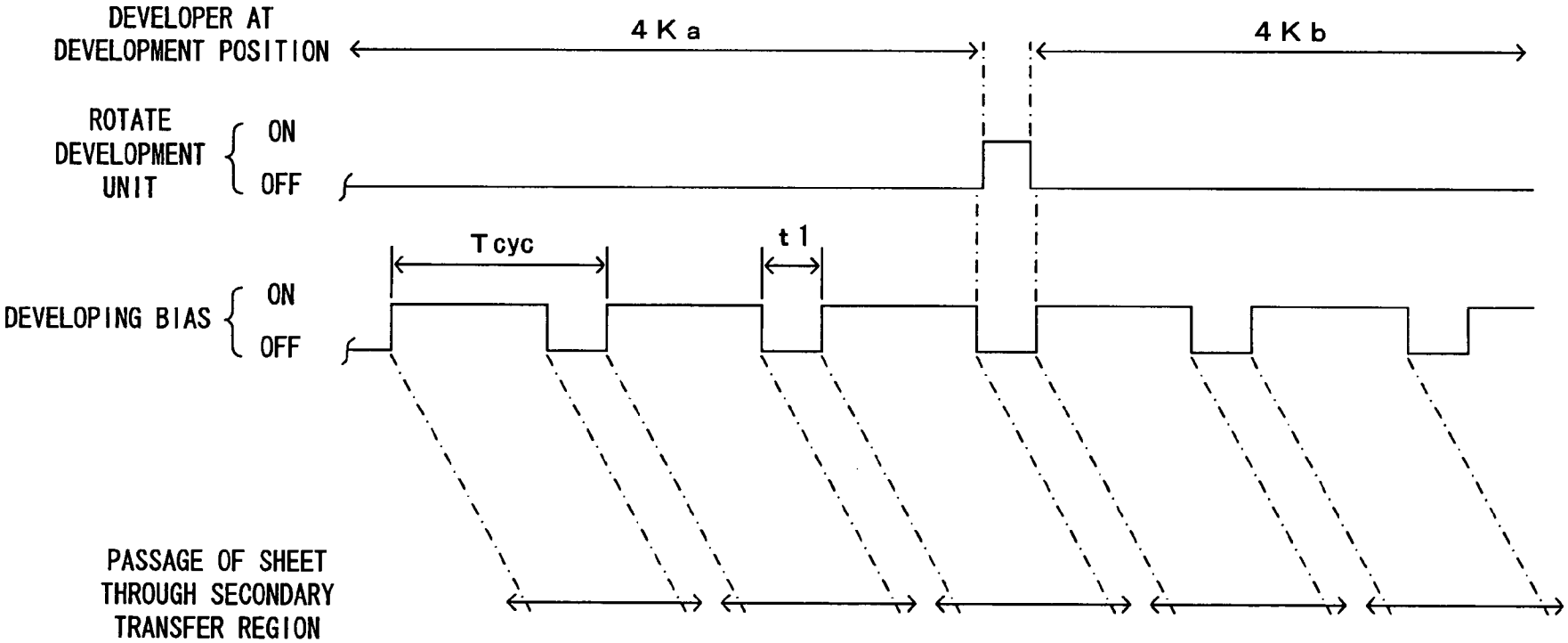
FIG. 24 is a timing chart showing the timings of operations of the individual parts in the case of the standard size sheet.

FIG. 23 is a flow chart showing the steps of the image forming operation according to the fifth embodiment. In this embodiment, when the image forming command is applied from the external source (Step S801), the respective locations of the developers mounted in the development unit 4 are determined (Step S802). Subsequently, a sheet size specified by the image forming command is determined (Step S803). It is noted here that the subsequent operations (Steps S806 to S811) are the same as those of the third embodiment described above, in a case where the sheet size is the standard A4 size FIG. 24 is a timing chart showing the timings of operations of the individual parts in the case of the standard size sheet. Since the operations of the individual parts of the apparatus are arranged on the basis of the standard sheet size, a cycle period Tcyc has a required and sufficient length of time to permit each of the standard size sheets fed in succession to be passed through the secondary transfer region TR2 with a minor interval between the sheets. This interval is corresponded by a time interval t1 during which the developer is not used. This time interval may be utilized for making the changeover of developers. Since the changeover in this case must be accomplished in a short time, a developer to be switched to is limited to that located adjacent to and upstream from the in-use developer. For instance, in a case where the developer 4Ka is used first while the developer 4Kb adjacent thereto and upstream therefrom is usable, the development unit 4 is rotated by 90 degrees at the point in time that the number of images formed by the developer 4Ka reaches the predetermined number, so that the developer 4Ka is switched to the developer 4Kb.

Returning to FIG. 23, the image forming operation is further described. In a case where the sheet size is B5 which is shorter than that of the standard sheet, the apparatus no more limits the object of changeover to that adjacent to and upstream from the in-use developer and permits the changeover also to any other developer (Step S804). A developer to be used first is one of the usable developers that has the longest shutdown time from the end of the previous use thereof. The subsequent operations are basically the same as those for the standard size sheet. However, the limitation of the object of changeover is removed, as described above. Therefore, it is also possible that the in-use developer is switched to a developer at any other place than that adjacent thereto and upstream therefrom, just as in the double-side print mode of the fourth embodiment.

Figure 25:
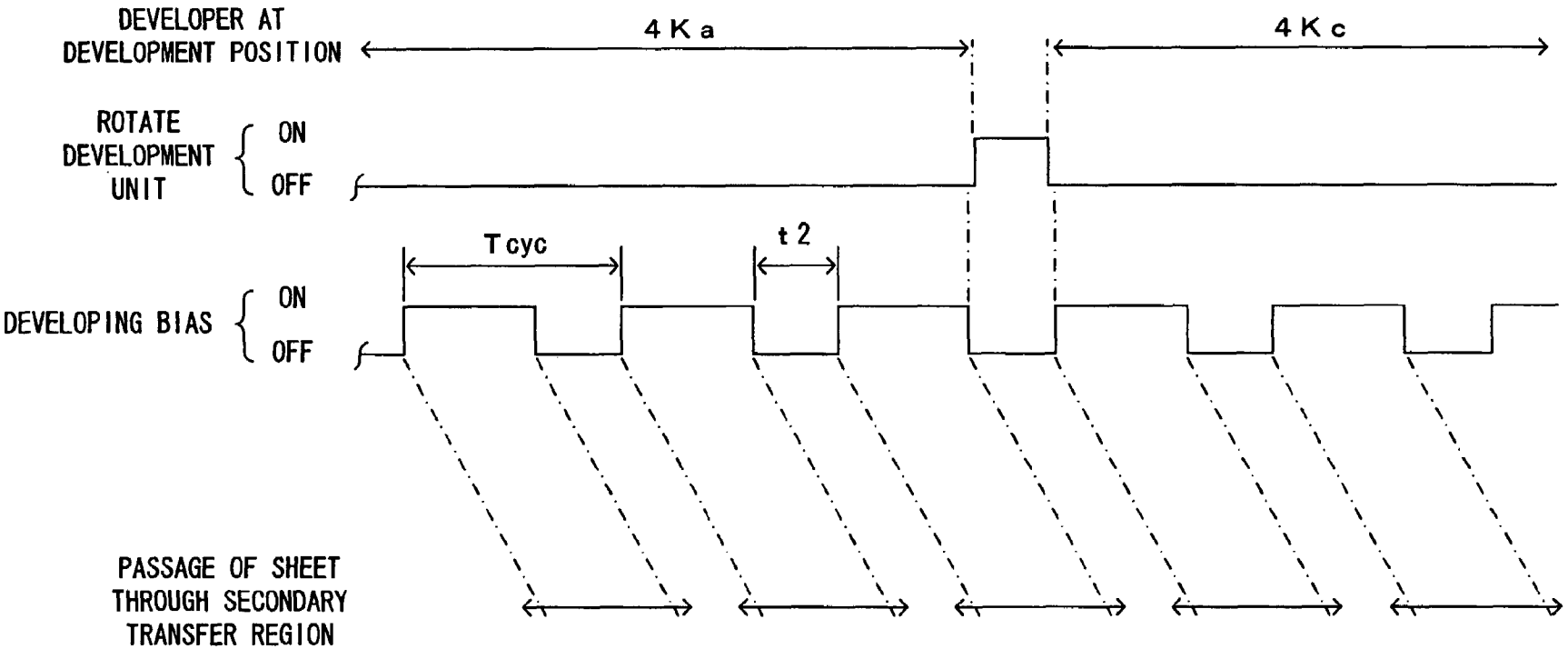
FIG. 25 is a timing chart showing the timings of operations of the individual parts in a case where a sheet size is shorter than the standard size.

FIG. 25 is a timing chart showing the timings of operations of the individual parts in a case where a sheet size is shorter than the standard size. In this case, the cycle period Tcyc of the operation sequence is the same as that of the operation sequence for the standard size sheet. However, the sheet size is shorter, so that a longer time interval t2 than that corresponding to the standard sheet size results. This time interval allows the development unit 4 to be rotated by more than 90 degrees. For instance, the development unit 4 may be rotated by 180 degrees for accomplishing changeover from the developer 4Ka to the developer 4Kc.

Returning to FIG. 23, an operation performed in the case of a legal-size sheet is described. Since the sheet has a longer size in this case, an interval between the formation of one image and the formation of the next image becomes shorter than in the case of the standard size sheet. As a result, this time interval is too short to accomplish the changeover of developers. In this case, therefore, the apparatus forms images without making the changeover of developers. That is, one developer having the longest shutdown time is selected from the usable developers and is transferred to the development position (Step S812). A required number of images are formed using the developer so positioned (Step S813). At completion of the image formation, the development unit 4 is returned to the home position after the memory of the used developer is updated (Step S814).

Figure 26:
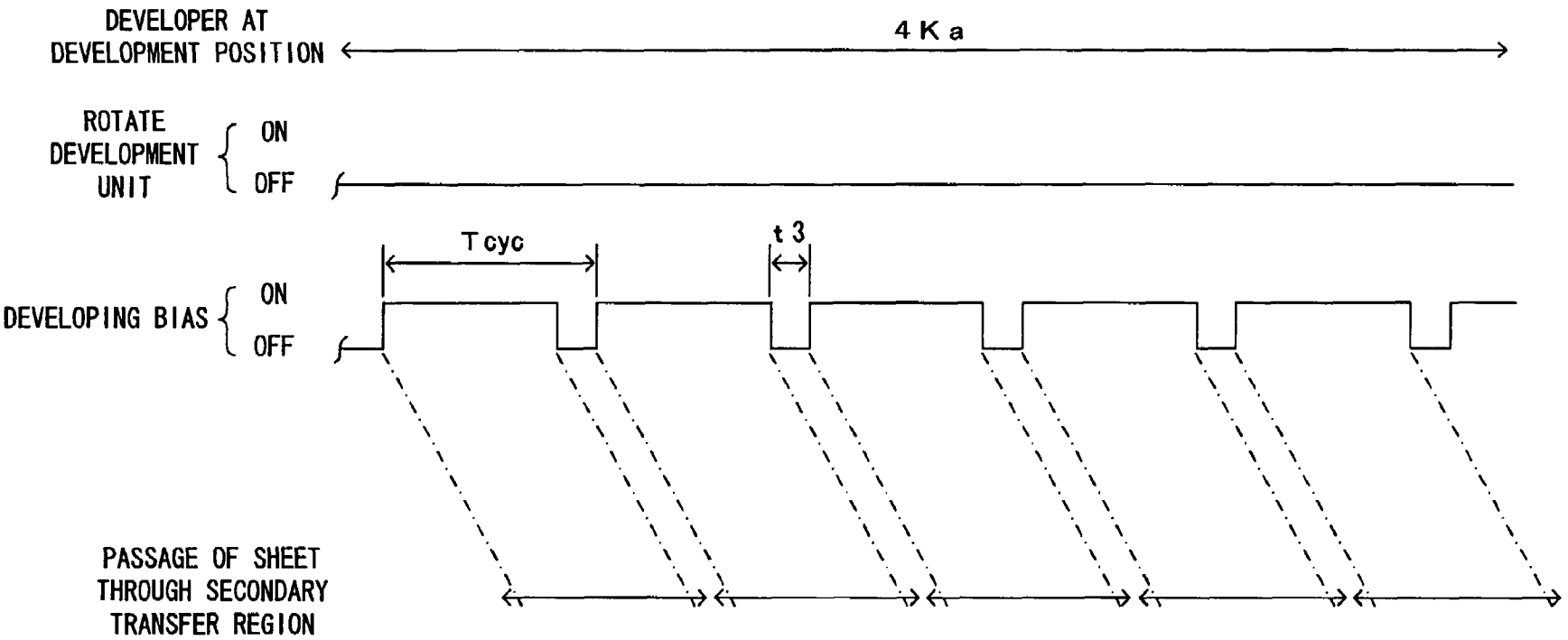
FIG. 26 is a timing chart showing the timings of operations of the individual parts in a case where a sheet size is longer than the standard size.

FIG. 26 is a timing chart showing the timings of operations of the individual parts in a case where a sheet size is longer than the standard size. In this case, as well, the cycle period Tcyc of the operation sequence is fixed. The sheet size is increased so that a time interval t3 is shorter than that corresponding to the standard sheet size. In this case, the apparatus does not make the changeover of developer in order to prevent the reduction of throughput, and continues to use the first-selected developer (the developer 4Ka, in this case) till the end of the operation. When the formation of a series of images corresponding to one image forming command is followed by the formation of images corresponding to another image forming command received anew, any other developer than the developer 4Ka may be used.

In this manner, the embodiment varies the mode of switching the development unit 4 according to the sheet size specified by the image forming command. Such an approach permits the same operation sequence to be applied to sheets of different sizes, thereby obviating the complication of controls. Furthermore, the selection of a proper developer and the changeover of developers are performed according to the difference of size of sheets, whereby the images may be formed using the individual developers efficiently.

As described in the foregoing, in the image forming apparatus according to the third embodiment of the invention, the mode of selecting and switching the developer varies depending upon the number of images to be formed in correspondence to the image forming command. Further, in the image forming apparatus according to the fourth embodiment, the mode of selecting and switching the developer varies depending upon whether the image is formed on one side of the sheet or on both sides of the sheet. Furthermore, in the image forming apparatus according to the fifth embodiment, the mode of selecting and switching the developer varies depending upon the sheet size specified by the image forming command. Any of these embodiments provides the consistent formation of images of good quality and the efficient use of the individual developers.

According to the third to fifth embodiments, as described above, the rotary development unit 4 functions as the "positioning unit" of the fourth aspect of the invention. The engine EG functions as an "image forming unit" of the fourth aspect of the invention. The rollers 81 and 82 and the like which constitutes the transportation path F and the reversal transportation path FR function, as a unit, as a "transportation device" of the fourth aspect of the invention. Further, in the third to fifth embodiments, the sheet S is equivalent to a "recording material".

Other Features

It is to be noted that the invention is not limited to the foregoing embodiments and various modifications other than the above may be made thereto unless such modifications deviate from the scope of the invention.

Modifications of the First Embodiment

According to the first embodiment, for example, the development unit 4 is capable of mounting up to four developers in the support frame 40 thereof and the developer cartridges 4Ka to 4Kd are mounted to all the mounting positions. The invention is also applicable to an apparatus wherein the development unit 4 is capable of mounting a different number of developers or wherein only a part of the mountable developers are mounted.

Further, according to the image formation executability determining process of the first embodiment, in a case where plural developers are classified in the same rank and demand the same preparatory operation, the preparatory operation is successively performed on such developers, but the invention is not limited to this. For instance, the preparatory operation may be performed only on one of these developers. This is because what is necessary is that at least one usable developer is available, as described above. In an alternative approach, for example, the preparatory operation may be sequentially performed on these developers, whereas at completion of the preparatory operation on the first developer, the apparatus may be determined to be ready for the image forming operation. When the preparatory operation on one developer is completed, the apparatus as a whole is able to perform the image forming operation. Furthermore, such an approach permits the apparatus to respond to the image forming command more quickly. The preparatory operation on the other developer yet to be subjected to the operation may be restarted at completion of the image forming operation, or may be omitted at this point in time if there is another usable developer.

While the first embodiment determines the statuses of the individual developers based on the two parameters of the residual toner quantity and the time of rotation of the developing roller, the information used for grasping the statuses of the developers is not limited to these. Alternatively, the statuses of the developers may be determined based on either one of the two information items or either information items in combination with another information item.

According to the first embodiment, the invention is applied to the image forming apparatus forming the black image as the monochromatic image. The invention is also applicable to an apparatus forming monochromatic images of another toner color.

According to the first embodiment, the image forming operation using the Rank-2 developer is permitted. However, an arrangement may also be made such that the user may choose to permit or inhibit the image formation using the Rank-2 developer according to the user's preference or needs.

While the first embodiment uses the four developer cartridges 4Ka to 4Kd of the same configuration, developer cartridges of different configurations may also be used. In the foregoing embodiment, the invention is applied to the so-called rotary-type image forming apparatus wherein the rotary development unit 4 is disposed corresponding to one photosensitive member 22. However, the invention is also applicable to a so-called elevator-type image forming apparatus wherein a plurality of developer cartridges are moved up or down relative to one photosensitive member 22 thereby permitting each of the developer cartridges to perform the image development, or to a so-called tandem-type image forming apparatus.

Furthermore, the invention is not limited to the constitution of the first embodiment and is also applicable, for example, to an apparatus equipped with a development unit mounted with plural developer cartridges each storing a toner of a specific color, so as to form images in the specific color, apparatuses including the other transfer media (e.g., transfer drum, transfer sheet) than the intermediate transfer belt, and the other image forming apparatuses such as copiers and facsimiles.

Modification of the Second Embodiment

The second embodiment, for example, pertains to an image forming apparatus which is dedicated for the monochromatic image and which is equipped with the four developers each storing the black toner. But, even in a full color image forming apparatus equipped with developers individually storing toners of different colors, the operation sequence according to the invention may be applied to image formation using some of the developers.

Modification of the Third to Fifth Embodiments

The image forming command applied to the actual image forming apparatus, for example, specifies the number of images to be formed, the one-side or double-side print and the sheet size. Therefore, the apparatus may be adapted to respond a variety of image forming commands by practicing the third to fifth embodiments in combination rather than discretely practicing the third to fifth embodiments.

Modification of the Second to Fifth Embodiments

While the second to fifth embodiments use the parameters of residual toner quantity, time of rotation of the developing roller and shutdown time in combination so as to determine whether each of the developers is usable or not, the usage of the parameters is not limited to this. Any of these parameters or any other parameter representing the operation history of the developer may be used alone or those parameters may be used in suitable combination for the determination on the usability of the developer.

While the second to fifth embodiments use the four developer cartridges 4Ka to 4Kd of the same configuration, developer cartridges of different configurations may also be used. In the foregoing embodiments, the invention is applied to the so-called rotary-type image forming apparatus wherein the rotary development unit 4 is disposed corresponding to one photosensitive member 22. However, the invention is also applicable to a so-called elevator-type image forming apparatus wherein a plurality of developer cartridges are moved up or down relative to one photosensitive member 22 thereby permitting each of the developer cartridges to perform the image development.

Furthermore, the invention is not limited to the constitution of the second to fifth embodiments and is also applicable, for example, to an apparatus including the other transfer media (e.g., transfer drum, transfer sheet) than the intermediate transfer belt, and the other image forming apparatuses such as copiers and facsimiles.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a plurality of developers each of which stores therein a toner of the same color and includes a toner carrier structured to rotate while carrying the toner on its surface; and a controller which executes an image forming operation using the developer in accordance with an image forming command, wherein the controller selects a developer from the plurality of developers based on a length of shutdown time from the end of use in the previous image forming operation and executes the image forming operation using the selected developer.

2. The image forming apparatus of claim 1, wherein the controller selects a developer of which the length of shutdown time is the longest.

3. The image forming apparatus of claim 1, wherein the controller selects a developer to be used in the image forming operation from some developers. which satisfy a predetermined usability requirement in the plurality of developers.

4. The image forming apparatus of claim 3, wherein the usability requirement is that a residual toner quantity stored in the developer exceeds a predetermined value.

5. The image forming apparatus of claim 3, wherein the usability requirement is that the length of shutdown time is shorter than a predetermined time period.

6. The image forming apparatus of claim 3, wherein the usability requirement is that a residual toner quantity stored in the developer exceeds a predetermined value and the length of shutdown time is shorter than a predetermined time period.

7. The image forming apparatus of claim 3, wherein the controller is structured to execute, on an as-needed basis, a preparatory operation which brings a developer improper to use for the image forming operation into a usable state, and the usability requirement is that the preparatory operation is not needed for the developer.

8. The image forming apparatus of claim 7, wherein the preparatory operation is an operation to rotate the toner carrier disposed in the developer.

9. The image forming apparatus of claim 7, wherein the preparatory operation is a density control operation in which operating conditions of individual parts of the apparatus are adjusted so that a density of an image formed by the image forming operation using the developer is controlled to a predetermined target density.

10. The image forming apparatus of claim 1, wherein the controller considers a duration time in which the toner carrier is at standstill as the shutdown time.

11. An image forming method comprising:

selecting a developer to use from a plurality of developers, each of which stores therein a toner of the same color and includes a toner carrier structured to rotate while carrying the toner on its surface, based on a length of shutdown time from the end of use in a previous image forming operation; and forming an image corresponding to an image forming command using the selected developer.

* * * * *